US010132523B2

(12) United States Patent
Barbely et al.

(10) Patent No.: US 10,132,523 B2
(45) Date of Patent: Nov. 20, 2018

(54) AIR HANDLING UNIT WITH CONDENSATION COLLECTION SYSTEM

(71) Applicant: Mitsubishi Electric Corporation, Tokyo (JP)

(72) Inventors: Allen Peter Barbely, Auburn, GA (US); Joseph Paul Bush, Suwanee, GA (US); Peter Christian Flynn, Suwanee, GA (US)

(73) Assignee: Mitsubishi Electric Corporation, Tokyo (JP)

( * ) Notice: Subject to any disclaimer, the term of this patent is extended or adjusted under 35 U.S.C. 154(b) by 415 days.

(21) Appl. No.: 14/528,225

(22) Filed: Oct. 30, 2014

(65) Prior Publication Data

US 2016/0123651 A1 May 5, 2016

(51) Int. Cl.

| | |
|---|---|
| ***F25D 21/14*** | (2006.01) |
| ***F24F 13/22*** | (2006.01) |
| ***F24F 13/20*** | (2006.01) |

(52) U.S. Cl.

CPC ..... *F24F 13/222* (2013.01); *F24F 13/20* (2013.01); *F25D 21/14* (2013.01); *F25D 2321/144* (2013.01); *F25D 2321/146* (2013.01)

(58) Field of Classification Search

CPC ..... F24F 13/22; F24F 13/222; F25D 21/14; F25D 2321/146; F25D 2321/144

See application file for complete search history.

(56) References Cited

U.S. PATENT DOCUMENTS

| | | | | |
|---|---|---|---|---|
| 3,596,475 | A | 8/1971 | Berger | |
| 3,720,074 | A * | 3/1973 | Jansen | F25D 21/14 62/272 |
| 4,151,726 | A * | 5/1979 | Schlueter | F24F 13/22 62/285 |
| 4,267,978 | A | 5/1981 | Manteufel | |
| 4,937,559 | A * | 6/1990 | Meacham | F24F 13/22 200/61.04 |
| 5,522,229 | A * | 6/1996 | Stuchlik, III | E03C 1/28 340/620 |
| 5,664,431 | A | 9/1997 | Martin, Sr. | |
| 5,694,785 | A * | 12/1997 | Balentine | F24F 13/22 62/274 |
| 5,904,053 | A | 5/1999 | Polk et al. | |
| 6,895,770 | B1 * | 5/2005 | Kaminski | F24F 13/222 62/150 |

(Continued)

*Primary Examiner* — Filip Zec

(74) *Attorney, Agent, or Firm* — Posz Law Group, PLC

(57) ABSTRACT

A condensation collection system including a housing, a heat-exchanging coil located in the housing, a drain pan located in the housing and underneath the heat-exchanging coil, a water-sensitive element located in the housing and underneath both the heat-exchanging coil and the drain pan. The drain pan is configured to collect condensation from an interior of the housing. The drain pan includes a bottom, three or more exterior walls that generally conform to an interior perimeter of the housing, a primary drain located on a first exterior wall selected from the three or more exterior walls, and a controlled overflow drain located on a second exterior wall selected from the three or more exterior walls. The primary drain is configured to drain collected condensation from the drain pan. The controlled overflow drain is configured to drain the collected condensation from the drain pan.

18 Claims, 19 Drawing Sheets

(56) References Cited

U.S. PATENT DOCUMENTS

| | | | | |
|---|---|---|---|---|
| 8,151,580 | B1 * | 4/2012 | Cantolino | G01F 23/241 62/150 |
| 8,220,282 | B2 * | 7/2012 | Hast | F25D 21/14 62/285 |
| 2002/0000093 | A1 * | 1/2002 | Lea | F24F 13/222 62/150 |
| 2011/0265508 | A1 * | 11/2011 | Piccione | F24F 13/222 62/291 |

* cited by examiner

AIR HANDLING UNIT WITH CONDENSATION COLLECTION SYSTEM

TECHNICAL FIELD

The present invention relates generally to air handling units that include a heat-exchanging coil and a water-sensitive element, which are both formed in a housing. More particularly, the present invention relates to a drain pan that collects condensation from the housing's interior, and drains the collected condensation in a manner as to not damage the water-sensitive element.

BACKGROUND

For decades, nearly all air handlers were composed of the same components: an air blower, a heat-exchanging coil, and a housing. However, due to recent advancements in electronics, most purely mechanical devices are now seeing electronics being included in the units. Electronic control circuits are being put into many devices in order to increase, e.g., the reliability of the device. In some air handlers, for example, electronic control units are being installed to give customers more options for controlling their air handling units.

In addition to these components, air handling units sometimes contain a drain pan. The drain pan is usually placed underneath the heat-exchanging coil in order to collect condensation from the heat-exchanging coil and the surrounding housing interior. After collecting condensation, there is usually a drain in the drain pan that allows collected condensation to exit the pan.

Traditionally, the air blower would be located at the top of a small box air handling unit, the heat-exchanging coil would be located underneath the air blower, and the drain pan would be located at the bottom of the small box air handling unit just below the heat-exchanging coil.

Unfortunately, traditional drains can often fail to properly remove collected condensation. One reason that traditional drains have failed was because algae or mold would grow in the moist environment inside the housing, and would clog the drain. Afterwards, the condensation would continue to collect within the drain pan, and eventually would overflow over the sides of the drain pan in an uncontrolled manner. In older units, the overflow was not as great a problem since the drain pan was usually located at the bottom of the small box air handling unit. That is, there was nothing underneath the drain pan to become damaged from the overflow, except for things immediately outside the unit itself.

A new issue, however, has occurred since the introduction of electronics into air handling units. Electronics, and many other water-sensitive elements, cannot operate correctly if collected condensation spills over onto the electronics itself. Unlike traditional air handling units, new electronic-based air handling units are filled with, e.g., electronic control devices placed throughout the housing itself. Thus, these electronic control devices, along with other water-sensitive elements (e.g., an air blower, an electronics or electrical component, electrical connector), are in jeopardy of being damaged when water overflows from a clogged drain pan. Furthermore, given the nature of air handling units, and the fact that they may be changed in orientation, it is possible that these water-sensitive elements could end up underneath the drain pan.

It would therefore be desirable to provide a way of emptying overfilled collected condensation from the drain pan in a way that would not disturb the electronics or the air blower, or any other water-sensitive device that may be installed within the air handling unit.

SUMMARY

A condensation collection system contains a housing, a heat-exchanging coil, a drain pan, and a water-sensitive element. The heat-exchanging coil is located in the housing. The drain pan is located in the housing and underneath the heat-exchanging coil. And the water-sensitive element is located in the housing, and underneath both the heat-exchanging coil and the drain pan.

The drain pan is configured to collect condensation from an interior of the housing. The drain pan includes a bottom and three or more exterior walls that generally conform to an interior perimeter of the housing.

The drain pan includes a primary drain located on a first exterior wall selected from the three or more exterior walls. The primary drain is configured to drain collected condensation from the drain pan. The drain pan also includes a controlled overflow drain located on a second exterior wall selected from the three or more exterior walls. And the controlled overflow drain is configured to drain the collected condensation from the drain pan.

In another embodiment, there is a given relationship between the water-sensitive element and the controlled overflow drain. For example, the shortest distance on a horizontal plane between the water-sensitive element and the controlled overflow drain is greater than one-half a length of the shortest exterior wall.

In another embodiment, there is a lowest point of the controlled overflow drain higher than a primary one-third point located one-third of the way from a lowest point of the primary drain to a highest point of the primary drain.

In another embodiment, the drain pan also includes three or more interior walls that define an aperture in the drain pan. This embodiment is sometimes referred to as the vertical drip pan since it is primarily, but not exclusively, used when the condensation collection system is placed in the vertical position.

In another embodiment, the second exterior wall is different from the first exterior wall.

In another embodiment, the lowest point of the controlled overflow drain is higher than a primary midpoint halfway between the lowest point of the primary drain and the highest point of the primary drain.

In another embodiment, the highest point of the controlled overflow drain intersects with a top edge of the second exterior wall In another embodiment, the controlled overflow drain has a shape, the shape is selected from the group consisting of a circle, a semicircle, an oval, a semi-oval, and a polygon.

In another embodiment, the controlled overflow drain includes a spout configured to drain the collected condensation.

In another embodiment, the controlled overflow drain includes a blocking piece connected to the second exterior wall by a plurality of connecting portions. And in some embodiments, the connecting portions are structurally weaker than the second exterior wall.

In another embodiment, the drain pan includes at least one secondary drain located on the first exterior wall, the secondary drain being configured to drain the collected condensation from the drain pan. And a lowest point of the controlled overflow drain is higher than a secondary midpoint halfway between a lowest point of the secondary drain and a highest point of the secondary drain, and a lowest point of the secondary drain is higher than the lowest point of the primary drain.

In another embodiment, the secondary drain leads to an alarm system configured to alert a user to a failure in the primary drain.

In another embodiment, the secondary drain leads to a controlled shutoff device, which is configured to shut off the evaporator coil.

In another embodiment, the water-sensitive element is an electronic control circuit configured to control operation of the heat-exchanging coil.

In another embodiment, the water-sensitive element is an air blower.

In another embodiment, the controlled overflow drain is formed in the first exterior wall and a third exterior wall selected from the three or more exterior walls, the third exterior wall being adjacent to the first exterior wall, the controlled overflow drain being formed across a corner of the drain pan where the first and third exterior walls intersect.

Another embodiment includes a drain pan for collecting condensation from the interior of a heating, ventilation, and air conditioning unit, comprising: a drain pan being configured to collect condensation, the drain pan having a bottom, three or more exterior walls that generally conform to an interior perimeter of the housing, three or more interior walls that define an aperture in the drain pan, a primary drain located on a first exterior wall selected from the three or more exterior walls, the primary drain being configured to drain collected condensation from the drain pan, and a controlled overflow drain located on a second exterior wall selected from the three or more exterior walls, the controlled overflow drain being configured to drain the collected condensation from the drain pan.

In another embodiment, a lowest point of the controlled overflow drain is higher than a primary one-third point located one-third of the way from a lowest point of the primary drain to a highest point of the primary drain.

BRIEF DESCRIPTION OF THE DRAWINGS

The foregoing will be apparent from the following more particular description of exemplary embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

A description of exemplary embodiments of the invention follows.

Air Handling Unit—First Orientation

While this disclosure contains references to air handling units, the condensation collection system also applies to heating, ventilation, and air conditioning units (HVAC units).

Figure 1:
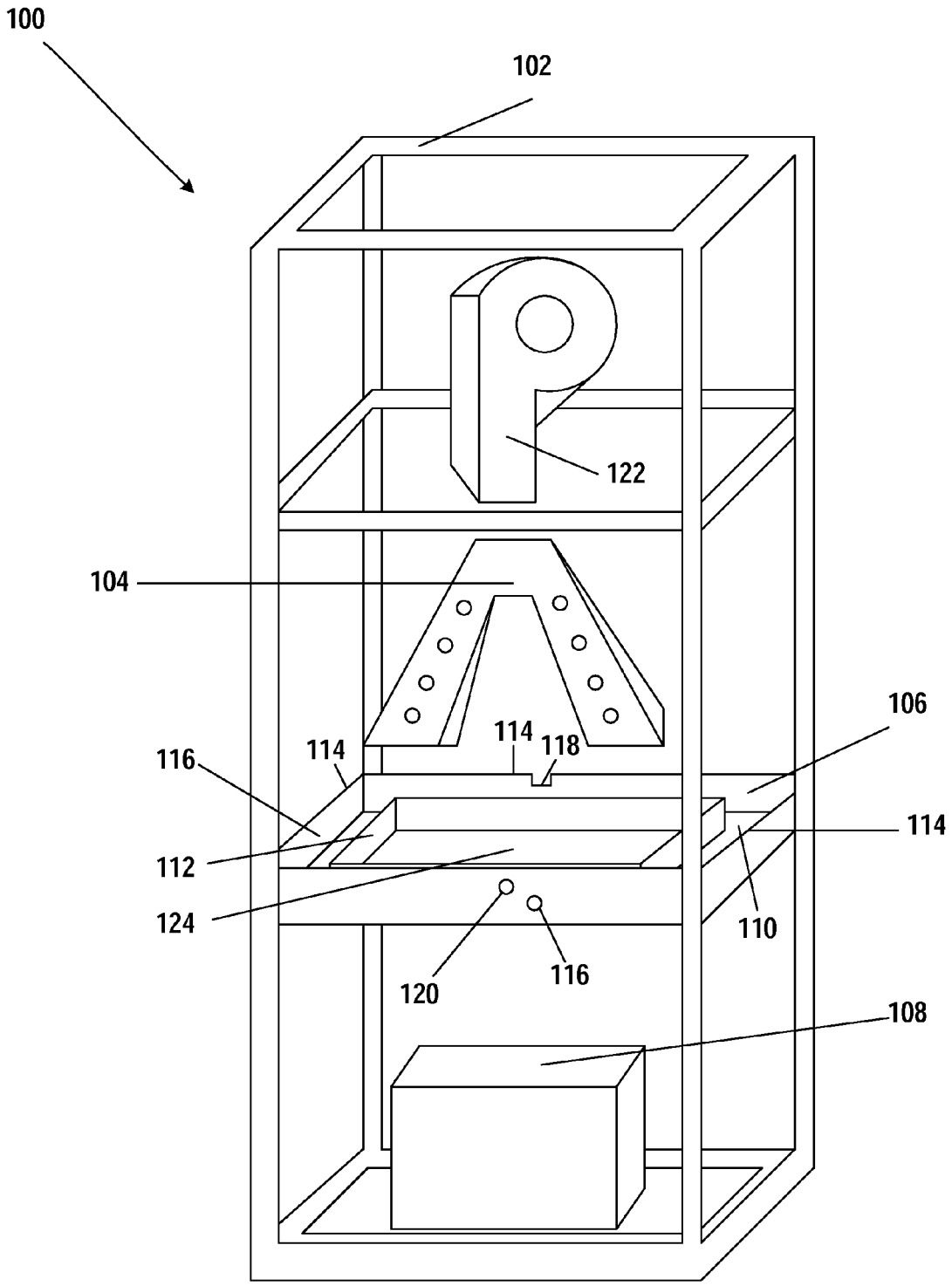
FIG. 1 is an oblique view of the condensation collection system placed in the vertical position according to a disclosed embodiment.

FIG.1 shows an air handling unit 100 with an air blower 122, a heat-exchanging coil 104, a |drain pan 106, a water-sensitive element 108, and a housing 102. The housing 102 encloses all of the components of the condensation collection system 100. After air enters into the housing, the heat-exchanging coil 104 cools the air, and then the air blower 122 blows the air outside of the housing.

During the heat exchanging process, there will be a temperature difference between the exterior and interior of the housing 102. Due to this temperature difference, condensation will form in the interior of the air handling unit 100. Condensation can form not only on the interior walls of the housing 102, but may also form on almost anything within the housing 102. For example, condensation may form on the heat-exchanging coil 104 and the air blower 122.

After condensation starts to collect in the interior of the housing 102, it must be collected for removal. FIG. 1 shows one embodiment that removes the condensation.

In FIG. 1, the vertical drain pan 106 collects the condensation from the interior of the housing 102. That is, condensation forms on, e.g., the interior of the housing 102 and drains into the vertical drain pan 106. After enough condensation has collected in the vertical drain pan 106, the level of water in the drain pan 106 will rise high enough to reach a primary drain 116. Once the collected condensation reaches the primary drain 116, the condensation can exit both the drain pan 106 and air handling unit 100.

Typically, collected condensation will exit the vertical drain pan 106 through the primary drain 116. However, if the primary drain 116 fails to properly remove the collected condensation, then the collected condensation can exit through a secondary drain 120. However, the secondary drain 120 may also fail to properly remove the collected condensation. In this case, the vertical drain pan 106 further includes a controlled overflow drain 118.

The controlled overflow drain 118 is positioned such that the collected condensation will avoid contacting the water-sensitive element 108 when the condensation flows out of it. Moreover, the water-sensitive element 108 and the controlled overflow drain 118 are positioned so the water-sensitive element 108 will not be damaged when collected condensation is removed from the vertical drain pan 106.

In some embodiments, the vertical drain pan 106 has an aperture 124 located roughly in the center of the vertical drain pan 106. The interior walls of the vertical drain pan 112 form the aperture 124. This aperture 124 allows air to move freely through the air handling unit 100.

In this embodiment, the vertical drain pan 106 will store the collected condensation between the interior walls of the vertical drain pan 112 and the exterior walls of the vertical drain pan 114.

As shown in the embodiment in FIG. 1, the condensation collection system 100 may contain a water-sensitive element 108 positioned underneath the heat-exchanging coil 104 and the vertical drain pan 106. Although this embodiment shows the air blower 122 being above the heat-exchanging coil 104 and the vertical drain pan 106, in alternate embodiments the air blower 122 may be located below the heat-exchanging coil 104 and the vertical drain pan 106, and so may be the water-sensitive element 108. The water-sensitive element 108 is positioned to avoid contact with collected condensation as the collected condensation exits the vertical drain pan 106 in a controlled manner.

Since it is desirable to keep the water-sensitive element 108 away from the controlled overflow drain 118, some embodiments will require a relationship between the water-sensitive element 108 and the controlled overflow drain 118. For example, in one embodiment, the shortest distance on a horizontal plane between the water-sensitive element 108 and the controlled overflow drain 118 is greater than one-half a length of the shortest exterior wall 114. This ensures that the water-sensitive element 108 will be placed sufficiently far away from the controlled overflow drain 118 so that if condensation flows out of the controlled overflow drain 118, it will not contact the water-sensitive element 108. Alternate embodiments can use a different spatial relationship, as desired.

Air Handling Unit—Second Orientation

The arrangement of the air handling unit 100 is not limited to the embodiment found in FIG. 1, in which the water-sensitive element 108 is located underneath both of the heat-exchanging coil 104 and the vertical drain pan 106, and the air blower 122 is located above the heat-exchanging coil 104 and the vertical drain pan 106.

Figure 2:
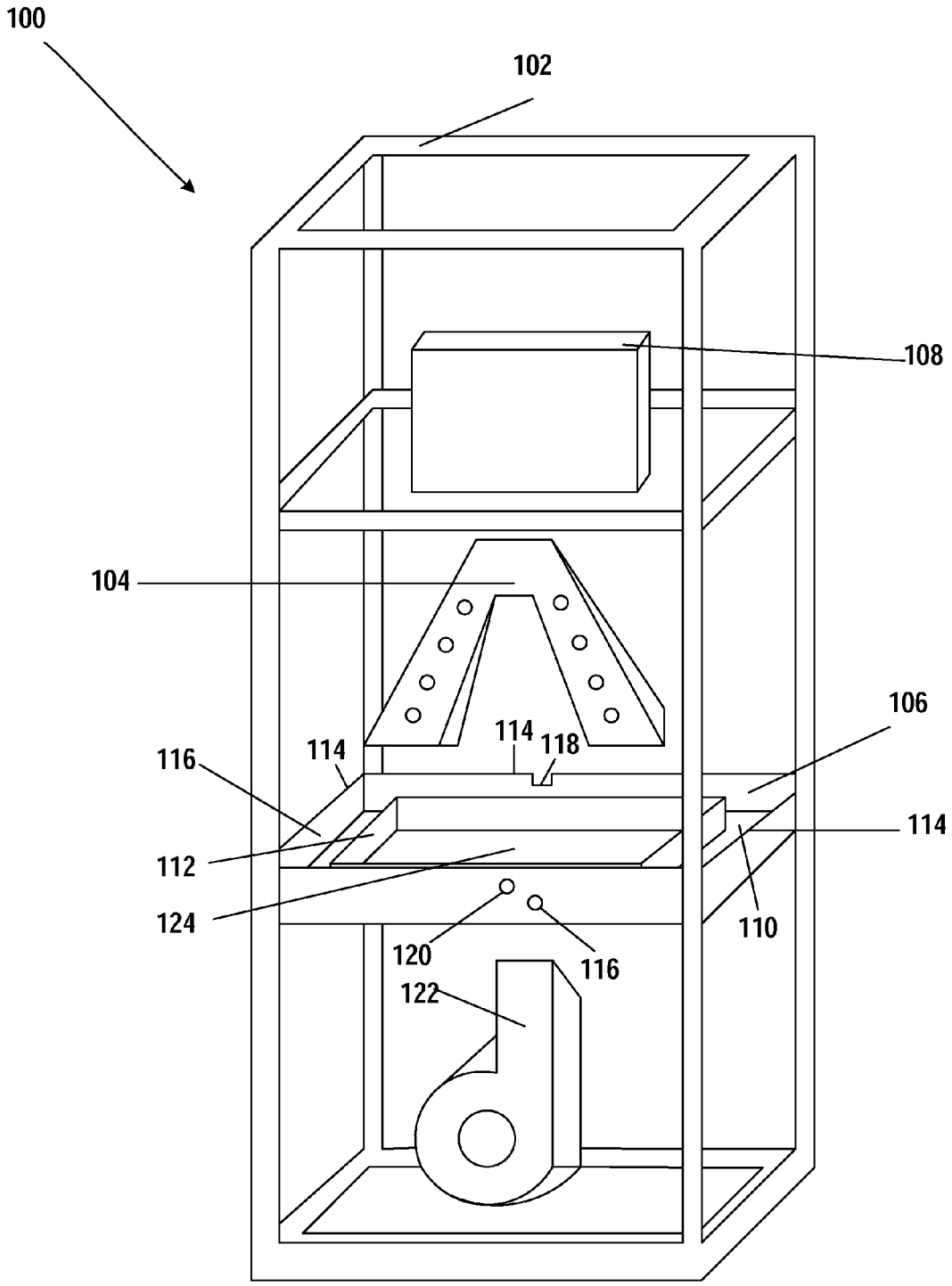
FIG. 2 is an oblique view of the condensation collection system placed in the vertical position according to a disclosed embodiment.

For example, FIG. 2 demonstrates an embodiment where the water-sensitive element 108 is located near the top of the housing 102. In this embodiment, the heat-exchanging coil 104 is below the water-sensitive element 108, and the vertical drain pan 106 is located just below the heat-exchanging coil 104. The air blower 122 is then located underneath the vertical drain pan 106. In this embodiment, the air blower 122 can be considered an additional water-sensitive element, since, e.g., the air blower's motor could be damaged if condensation that collected in the vertical drain pan 106 spilled over and onto the air blower 122.

As shown in FIG. 2, the vertical drain pan 106 is configured to collect condensation from an interior of the housing 102. The vertical drain pan 106 includes a bottom 110, and four exterior walls 114 that generally conform to an interior perimeter of the housing 102, and four interior walls 112, each slightly smaller than their exterior counterpart.

The vertical drain pan 106 includes a primary drain 116 located on an exterior wall 114 (e.g., a first exterior wall) selected from the four exterior walls 114. The primary drain 116 is configured to drain collected condensation from the vertical good sleep drain pan 106. The drain pan 106 also includes a controlled overflow drain 118 located on another exterior wall 114 (e.g., a second exterior wall) selected from the four exterior walls 114. The controlled overflow drain 118 is configured to drain the collected condensation from the vertical drain pan 106 when the primary drain 116 fails to perform this function.

Air Handling Unit—Third Orientation

Figure 3:
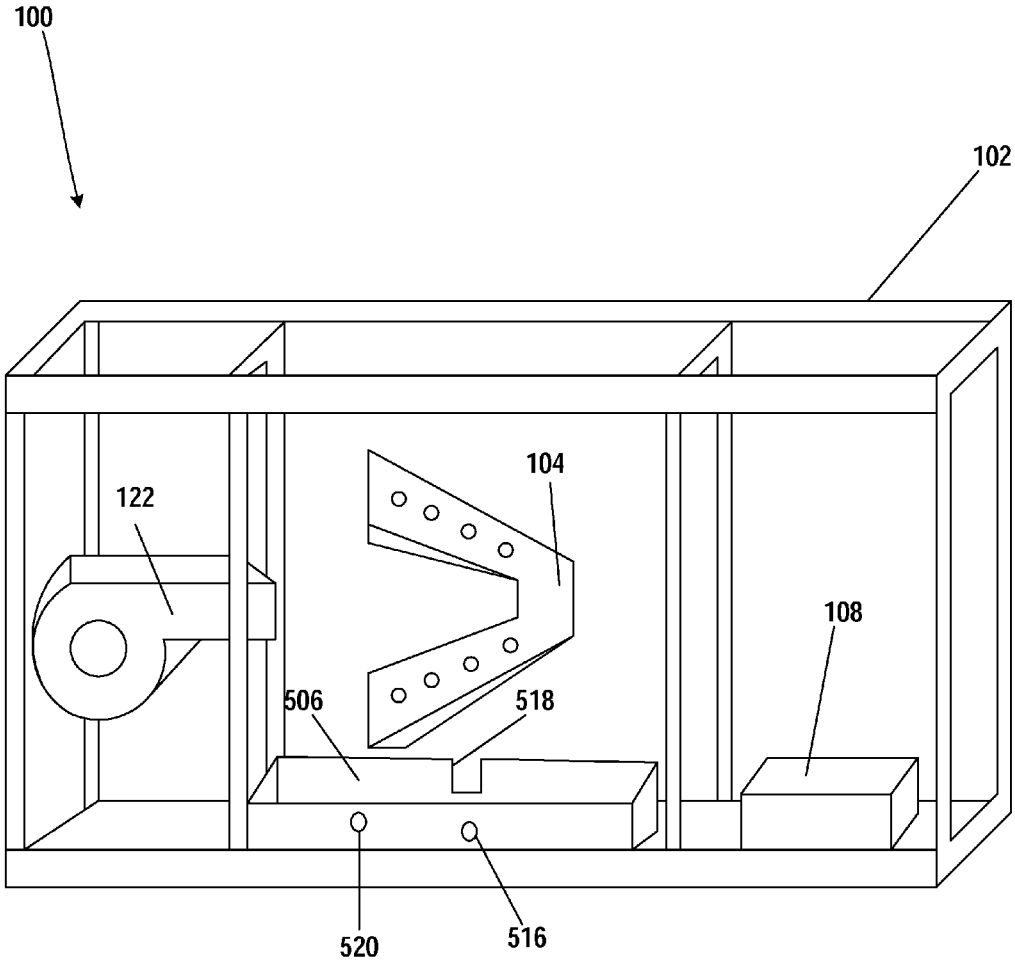
FIG. 3 is an oblique view of the condensation collection system placed in the horizontal position according to a disclosed embodiment.

FIG. 3 shows that the air handling unit 100 is not limited to a vertical arrangement, such as shown in FIGS. 1 and 2. In FIG. 3 the air handling unit 100 is in the horizontal position.

As shown in FIG. 3, the air handling unit 100 includes an air blower 122 at one end of the housing 102, a water-sensitive element 108 at the other end of the housing 102, and a heat-exchanging coil 104 between the air blower 122 and the water-sensitive element 108. In this embodiment, a horizontal drain pan 506 is located underneath the heat-exchanging coil 104.

The horizontal drain pan 506 is located directly underneath the heat-exchanging coil 104. It operates to collect the condensation falling from the heat-exchanging coil 104, as well as the condensation that forms on the interior of the housing 102. Thus, condensation that forms on the interior of the housing, will fall into the horizontal drain pan 506 for collection.

Similar to the vertical drain pan 106 in FIGS. 1 and 2, the horizontal drain pan 506 in FIG. 3 has a primary drain 516 that permits collected condensation to exit both the air handling unit 100 and the horizontal drain pan 506. However, as noted above, the primary drain 516 may become clogged. If this occurs, some embodiments contain a secondary drain 520 that may ensure that collected condensation can be removed safely from the air handling unit 100. However, in case both the primary drain 516 and the secondary drain 520 fail to properly remove the collected condensation, the horizontal drain pan 506 contains a controlled overflow drain 518.

Furthermore, unlike the vertical drain pan 106 of FIGS. 1 and 2, the horizontal drain pan 506 does not require an aperture in its middle. Because the air handling unit 100 is on its side, the airflow through the air handling unit 100 passes above the horizontal drain pan 506.

The controlled overflow drain 518 of the horizontal drain pan 506 is positioned in a way so that when collected condensation exits through the controlled overflow drain 518, the condensation will not come into contact with either the water-sensitive element 108 or the air blower 122.

Multiple Drain Pans

Figure 4:
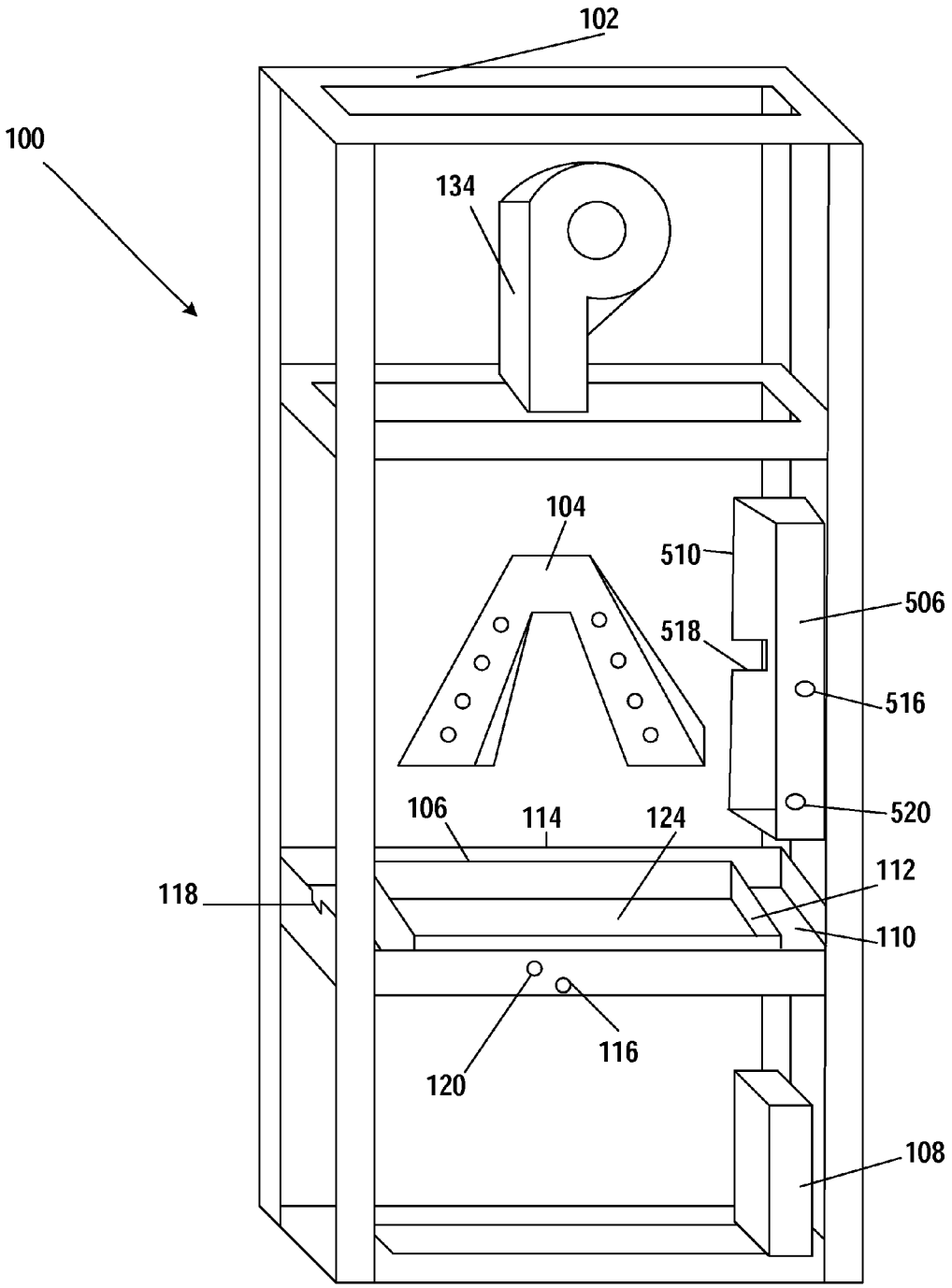
FIG. 4 is an oblique view of the condensation collection system placed in the vertical position according to a disclosed embodiment.

In other embodiments, an air handling unit 400 is provided with multiple drain pans 106 so that the air handling unit 400 can be placed either in a vertical orientation or a horizontal orientation, and the condensation will still be collected. For example, the embodiment in FIGS. 4 and 5 show embodiments that include a water-sensitive element 108, a vertical drain pan 106, a horizontal drain pan 506, a heat-exchanging coil 104, and an air blower 122.

In this embodiment, and in the vertical orientation of FIG. 4, the water-sensitive element 108 is located below the vertical drain pan 106. The heat-exchanging coil 104 is located above the vertical drain pan 106 and adjacent to the horizontal drain pan 506. The air blower 122 is located above both the heat-exchanging coil 104 and the horizontal drain pan 506. The vertical drain pan 106 is placed so that if the air handling unit 400 is placed in a vertical orientation, the vertical drain pan 106 will be located underneath the heat-exchanging coil 104.

Figure 5:
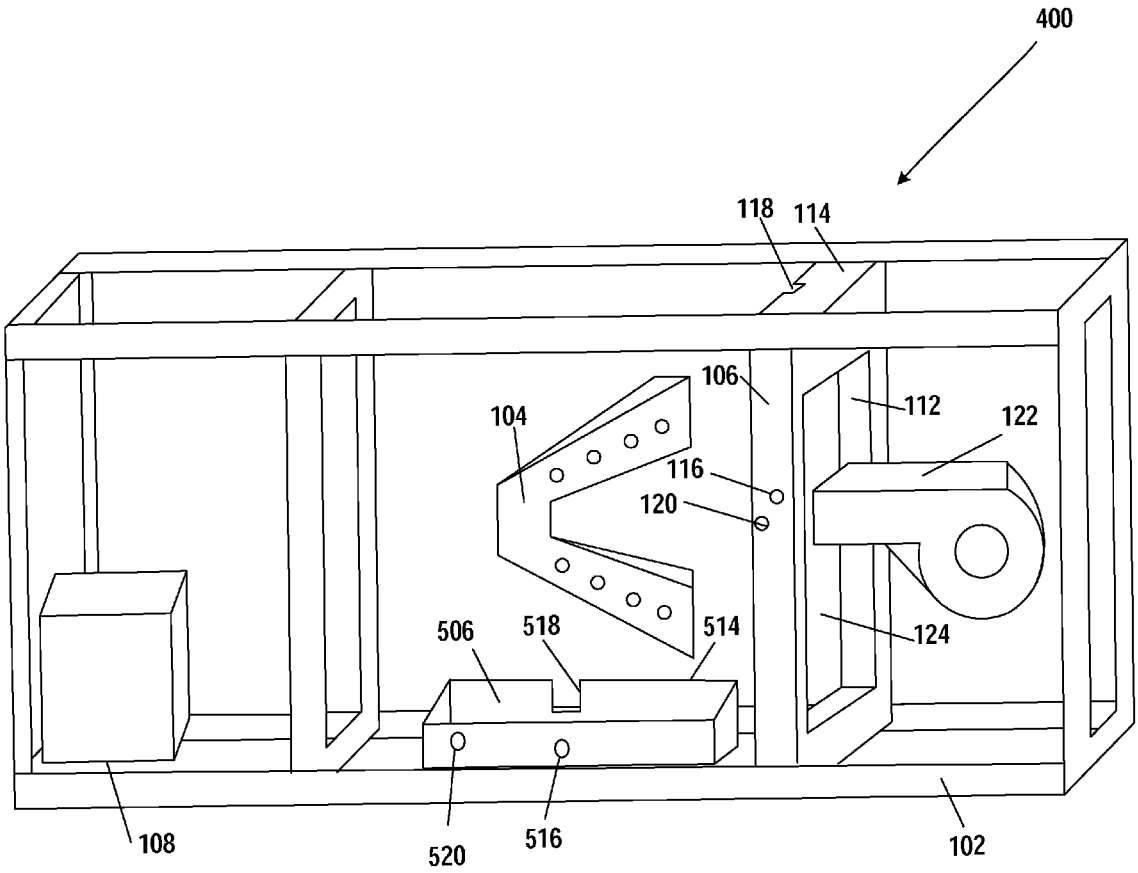
FIG. 5 is an oblique view of the condensation collection system placed in a horizontal position according to a disclosed embodiment.
Figure 6:
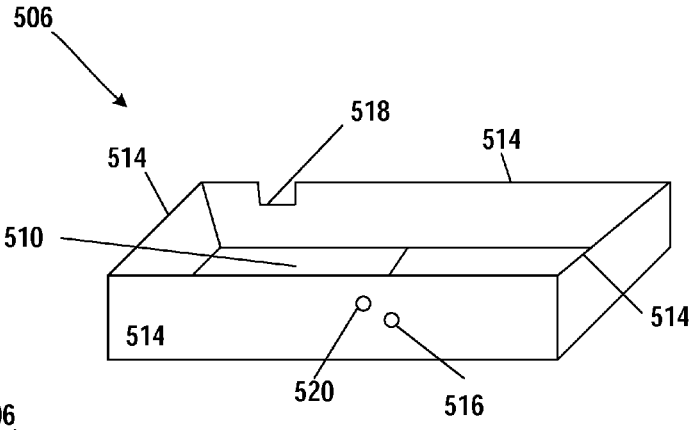
FIG. 6 is an oblique view of the drain pan according to a disclosed embodiment.
Figure 7:
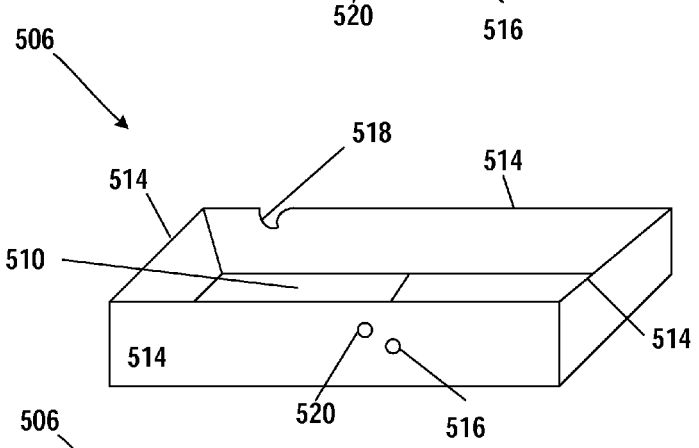
FIG. 7 is an oblique view of the drain pan according to a disclosed embodiment.
Figure 8:
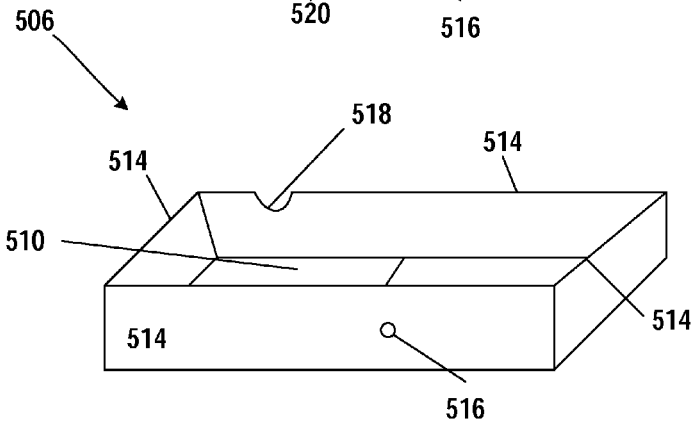
FIG. 8 is an oblique view of the drain pan according to a disclosed embodiment.

Similarly, the horizontal drain pan 506 is placed in a position so that if the air handling unit 400 is placed in a horizontal orientation (as shown in the embodiment of FIG. 5), the horizontal drain pan 506 will be located underneath the heat-exchanging coil 104.

Again, since the vertical drain pan 106 is located between the heat-exchanging coil 104 and the air blower 122, it must not impede the flow of air through the air handling unit 400. To this end, the vertical drain pan 106 contains exterior walls 114 and interior walls 112. The interior walls 112 of the vertical drain pan 106 form an aperture 124, which permits air to flow through the air handling unit 100.

In this embodiment of FIGS. 4 and 5, the horizontal drain pan 506 contains a primary drain 516 that permits collected condensation to be removed from the drain pan. If the primary drain 516 fails to remove the collected condensation (e.g., it becomes clogged), then some horizontal drain pans 506 contain a secondary drain 520. The secondary drain 520 can remove collected condensation from the interior of the housing 102 when the primary drain 516 fails to remove the condensation.

When the air handling unit 400 is in the orientation of FIG. 5, and both the primary drain 516 and the secondary drain 520 fail to remove the collected condensation, the condensation can exit through a controlled overflow drain 518. The controlled overflow drain 518 of the horizontal drain pan 506 is positioned such that draining condensation will flow away from the water-sensitive element 108. That is, the flow of water out of the controlled overflow drain 518 will not contact either the water-sensitive element 108 or the air blower 122. If the horizontal drain pan 506 did not have a controlled overflow drain 518, then collected condensation would randomly flow over the exterior walls of the horizontal drain pan 514, and might contact either the water-sensitive element 108 or the air blower 122.

In this embodiment with the controlled overflow drain 518, however, the collected condensation will empty in a way to not damage the water-sensitive element 108 or the air blower 122.

Similarly, in this embodiment the vertical drain pan 106 contains a primary drain 116. The primary drain 116 allows collected condensation to flow out of the vertical drain pan 106 when the air handling unit 400 is placed in the vertical position. In addition, this embodiment contains a secondary drain 120 that may allow collected condensation to exit the vertical drain pan 106 when the primary drain 116 fails (e.g., the primary drain 116 is clogged). If both the primary drain 116 and the secondary drain 120 fail to permit the collected condensation to exit the vertical drain pan 106, then the collected condensation can exit through a controlled overflow drain 118. As with the controlled overflow drain 518, the controlled overflow drain 118 is positioned in a way so that when it drains, the water-sensitive element 108 will not get wet.

Although the embodiment of FIGS. 4 and 5 shows the vertical drain pan 106 being between the heat-exchanging coil 104 and the water-sensitive element 108, it can be moved should the air handling unit 400 be placed in the opposite vertical orientation (i.e., with the air blower 122 below the heat-exchanging coil 104 and the water-sensitive element 108 above the heat-exchanging coil 104, the vertical drain pan 106 can be moved such that it is below the heat-exchanging coil 104, and acts to protect the air blower 122 from getting wet.

Similarly, although the embodiment of FIGS. 4 and 5 shows the horizontal drain pan 506 being located on a particular side of the air handling unit 400, if the air handling unit 400 is placed in a horizontal orientation opposite that shown in FIG. 5, the horizontal drain pan 506 can be moved such that it is below the heat-exchanging coil 104 and acts to protect both the water-sensitive element 108 and the air blower 122 from getting wet.

The Drain Pan

FIGS. 6-12 are oblique views of a drain pan 106, 506 according to disclosed embodiments. As shown in FIGS. 6-10, a horizontal drain pan 506 contains a bottom 510 and four exterior walls 514. The bottom 510 of the horizontal drain pan 506 along with the four exterior walls 514 hold the collected condensation. One of the four exterior walls 514 contains a primary drain 516. Some embodiments of the horizontal drain pan 506 contain a secondary drain 520. For example, FIGS. 6, 7, 9 and 10 contain a secondary drain 520, but the embodiment in FIG. 8 does not have a secondary drain 520. The horizontal drain pan 506 will also include at least one controlled overflow drain 518. The controlled overflow drain 518 can be formed in a number of shapes.

Figure 11:
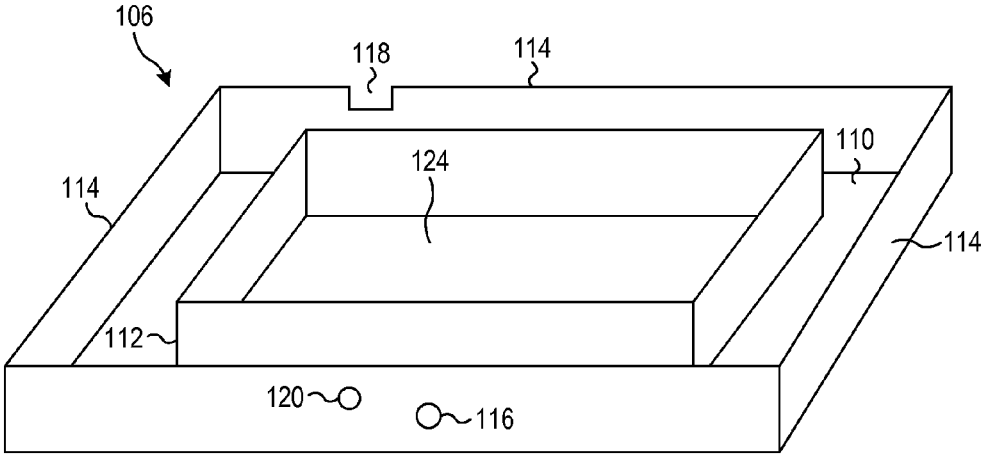
FIG. 11 is an oblique view of the drain pan according to a disclosed embodiment.
Figure 12:
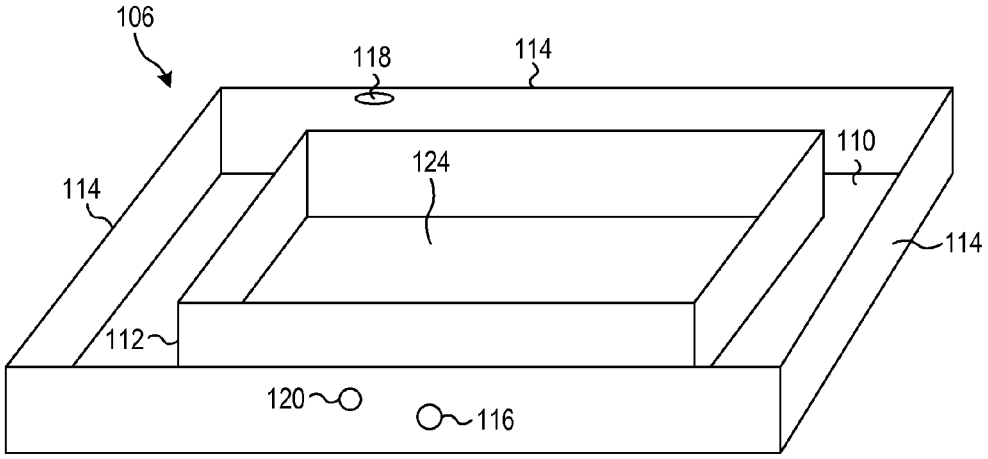
FIG. 12 is an oblique view of the drain pan according to a disclosed embodiment.
Figure 13:
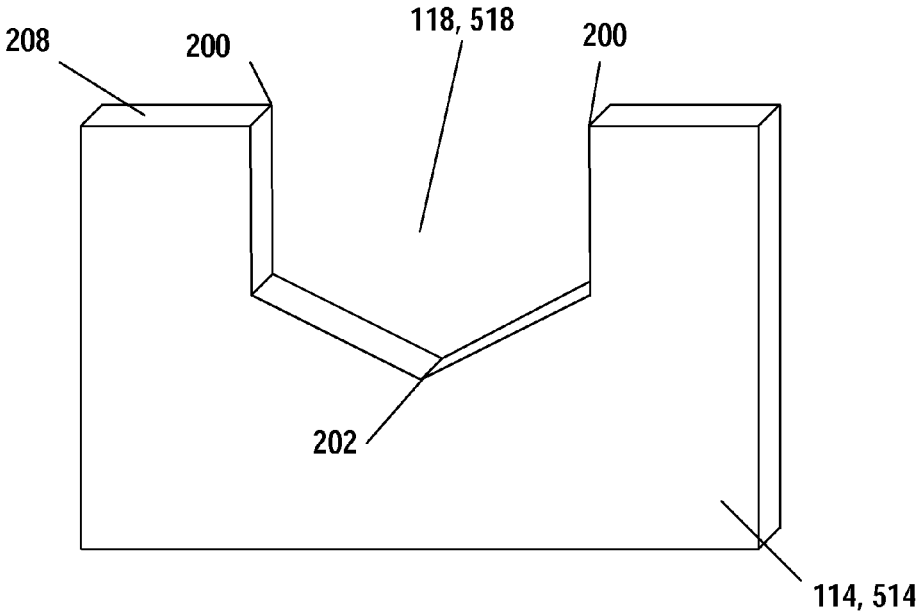
FIG. 13 is an oblique view of the controlled overflow drain according to a disclosed embodiment.
Figure 14:
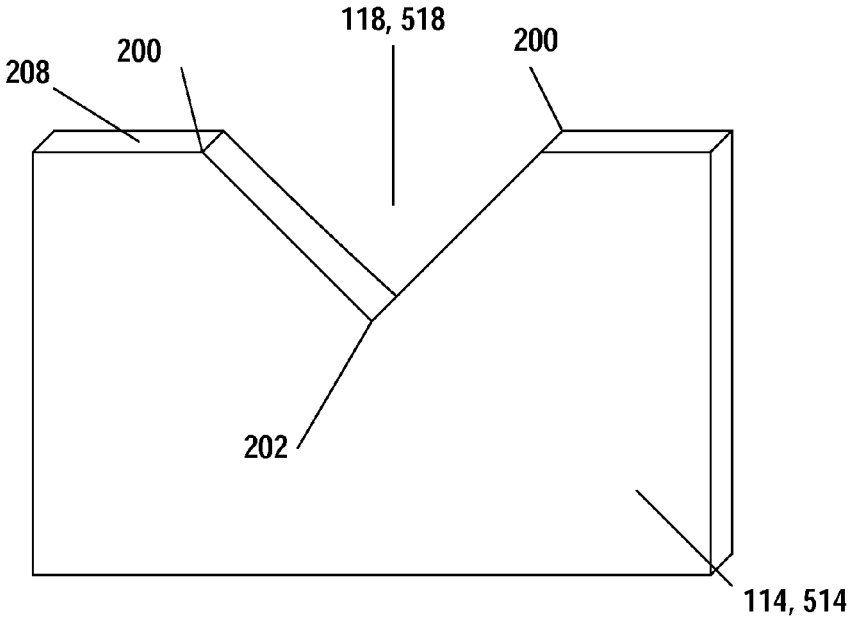
FIG. 14 is an oblique view of the controlled overflow drain according to a disclosed embodiment.
Figure 15:
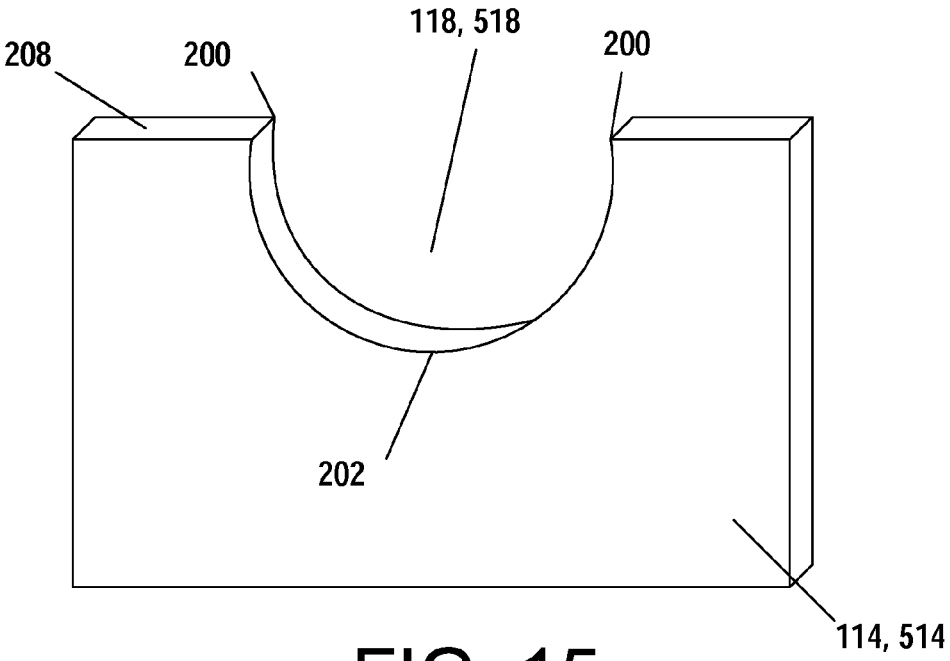
FIG. 15 is an oblique view of the controlled overflow drain according to a disclosed embodiment.

In FIGS. 11 and 12, the vertical drain pan 106 has a bottom 110, four exterior walls 114, and four interior walls 112. The four interior walls 112 form an aperture 124 located, in some embodiments, generally in the center of the vertical drain pan 106. One of the exterior walls 114 of the vertical drain pan 106 contains a primary drain 116. The primary drain 116 allows collected condensation to exit the vertical drain pan 106. Note that the collected condensation is held between the exterior walls 114 and interior walls 112. If the primary drain 116 fails to release the collected condensation, some embodiments include a secondary drain 120. The secondary drain allows collected condensation held between the exterior walls 114 and interior walls 112 to exit the vertical drain pan 106.

Figure 9:
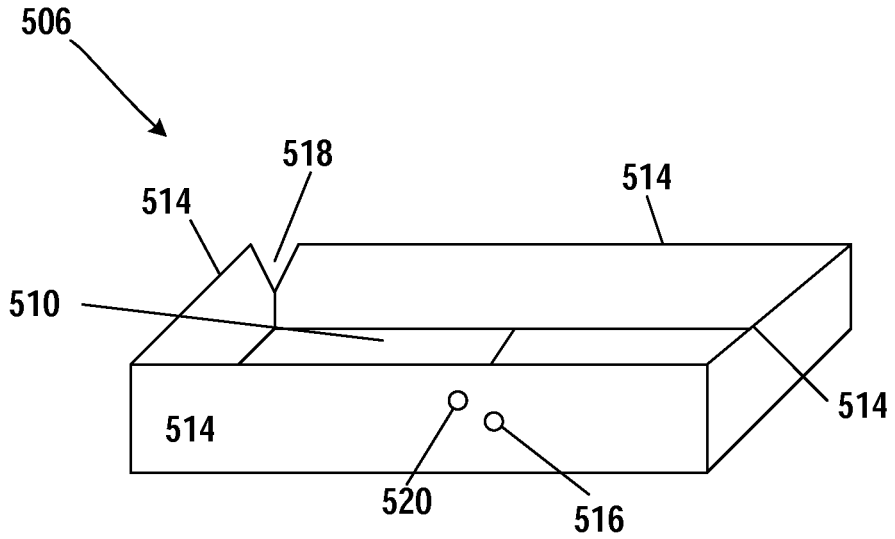
FIG. 9 is an oblique view of the drain pan according to a disclosed embodiment.

In some embodiments, the controlled overflow drain 118, 518 can be formed at the intersection of two exterior walls 114, 514 such as is shown in FIG. 9.

Figure 10:
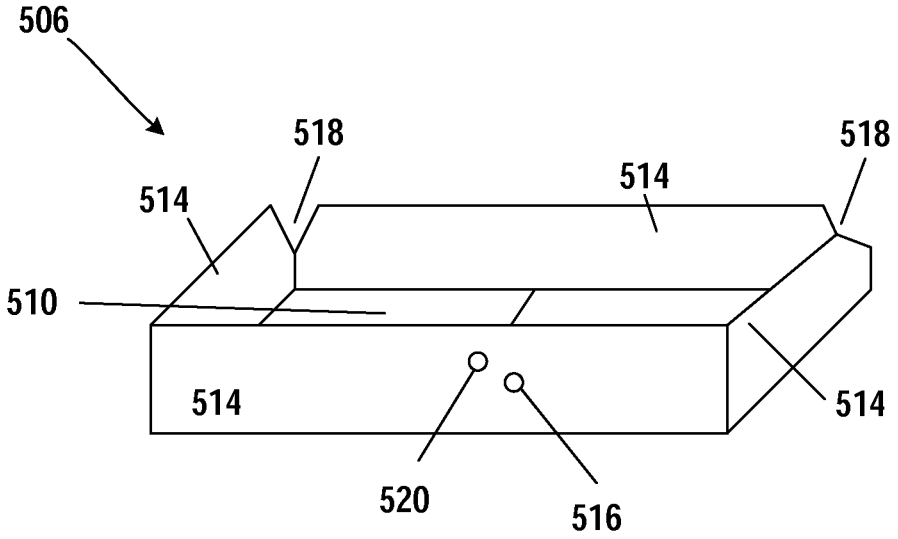
FIG. 10 is an oblique view of the drain pan according to a disclosed embodiment.

Likewise, the drain pans 106, 506 are not limited to containing a single controlled overflow drain 118, 518. In some embodiments, the drain pans 106, 506 can employ multiple controlled overflow drains 118, 518. For example, FIG. 10 shows a horizontal drain pan 506 with two horizontal controlled overflow drains 518. In this embodiment, the two horizontal controlled overflow drains 518 are each located at the intersection of exterior walls 514. These embodiments also apply to the vertical controlled overflow drain 118.

Note that the term "vertical" in vertical drain pan 106 does not refer to the positioning of the vertical drain pan 106 itself, but refers to the air handling unit 100 being positioned in a vertical orientation. Similarly, the term horizontal in horizontal drain pan 506 does not refer to the positioning of the horizontal drain pan 506 itself, but refers to the air handling unit 100 being positioned in a horizontal orientation.

The Shape of the Controlled Overflow Drain

In various embodiments the vertical controlled overflow drain 118 and horizontal the controlled overflow drain 518 may have different shapes. FIGS. 13-25 disclose various embodiments for the overflow drains 118, 518. These embodiments apply equally to vertical controlled overflow drains 118 and horizontal controlled overflow drains 518.

If the primary drain 116, 516 and the secondary drain (if present) both fail to allow collected condensation to exit from the drain pan 106, 506 then collected condensation can exit through a controlled overflow drain 118, 518. The controlled overflow drain 118, 518 can come in various shapes. For example in FIG. 11 the controlled overflow drain 118 is a notch that intersects with a top edge of the exterior wall 114. In other embodiments, such as FIG. 12, the controlled overflow drain 118, 518 does not need to intersect with a top edge of the exterior wall 114, 514, but can be located entirely within the exterior wall 114, 514.

FIGS. 13-26 demonstrate some of the variety of shapes the controlled overflow drain 118, 518 can take.

In these embodiments, the controlled overflow drain 118, 518 has a controlled high point 200, representing the highest point of the overflow drain 118, 518, and a controlled low point 202, representing the lowest point of the overflow drain 118, 518. The controlled overflow drain 118, 518 can intersect with a top edge 208 of the exterior wall 114, 514 of the drain pan 106, 506. The controlled overflow drain 118, 518 can be one of many shapes, including a polygon, such as a pentagon in FIG. 13, or a triangle in FIG. 14. In other embodiments, the controlled overflow drain 118, 518 can have the shape of a circle, a semicircle, an oval, a semi-oval, or even an irregular shape.

Figure 16:
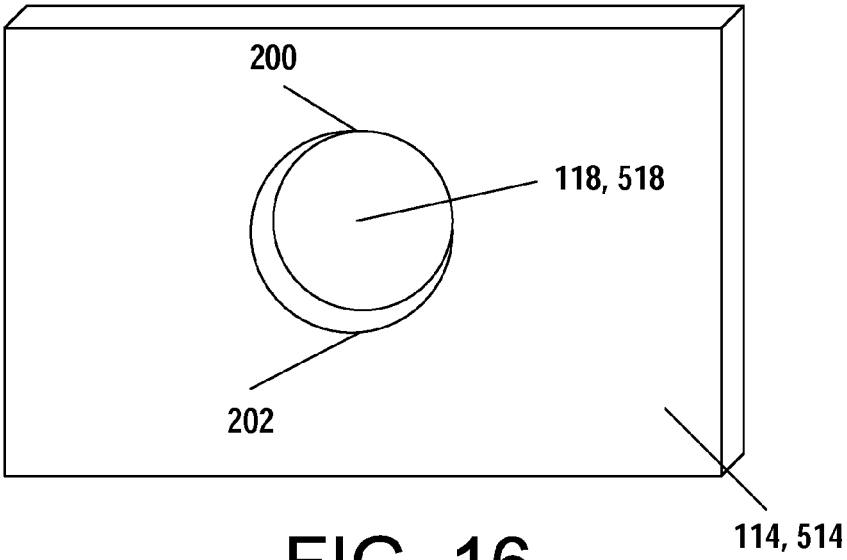
FIG. 16 is an oblique view of the controlled overflow drain according to a disclosed embodiment.

Further, FIG. 16 demonstrates a controlled overflow drain 118, 518 in the shape of a circle with a controlled high point 200 and a controlled low point 202. Similarly, FIG. 15 demonstrates a controlled overflow drain 118, 518 that is in the shape of a circle with a high point 200 and a low point 202. Unlike FIG. 16, the controlled overflow drain 118, 518 in FIG. 15 intersects with a top edge 208 of an exterior wall 114, 514 (e.g., a second exterior wall). This same principle is demonstrated when viewing FIG. 17 with respect to FIG. 18.

Figure 17:
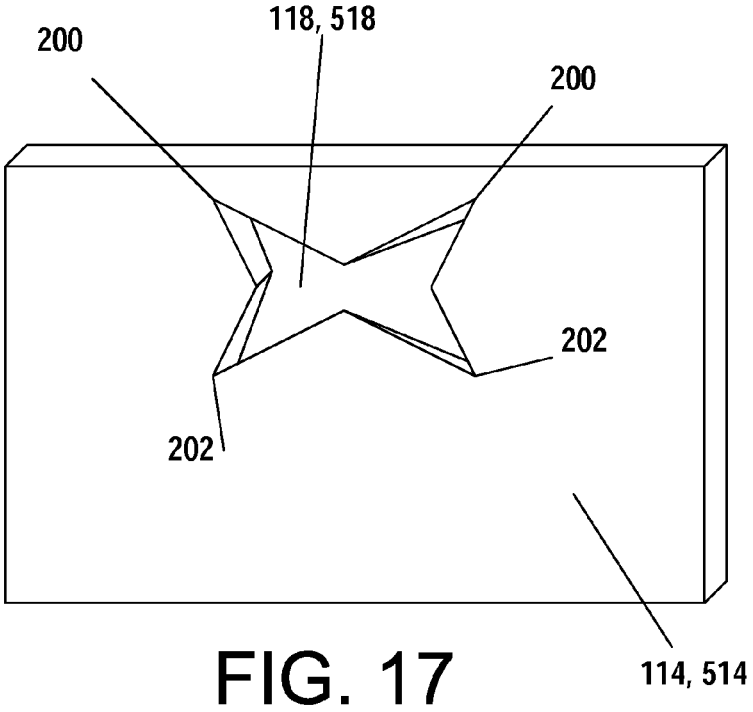
FIG. 17 is an oblique view of the controlled overflow drain according to a disclosed embodiment.
Figure 18:
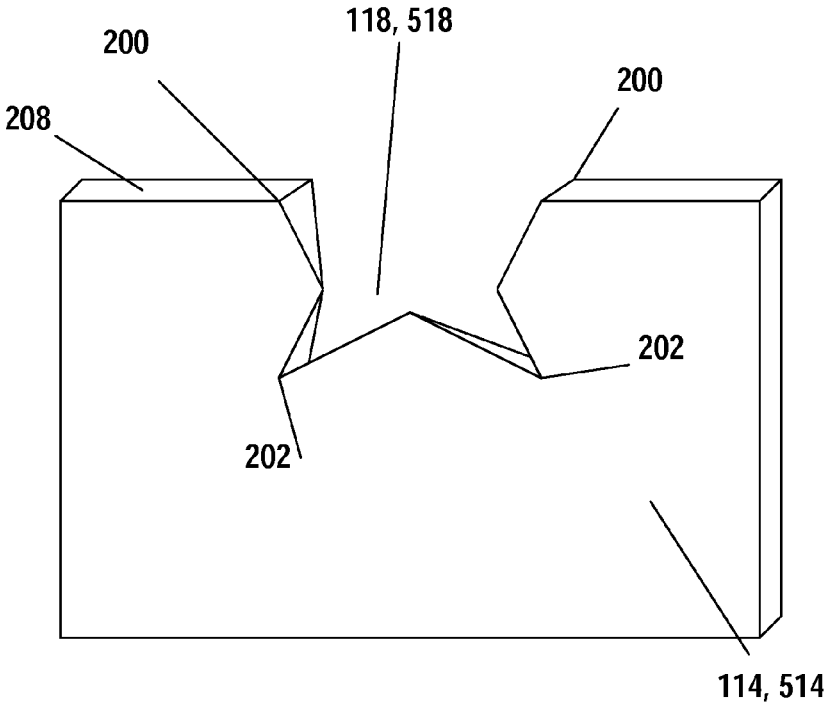
FIG. 18 is an oblique view of the controlled overflow drain according to a disclosed embodiment.

Even when the controlled overflow drain 118, 518 is an irregular shape there is still a controlled high point 200 and a controlled low point 202. That is, the mere fact that a given shape has, e.g., multiple points that reach the highest point does not mean it is not within the scope of this embodiment. FIGS. 17 and 18 show two embodiments with irregular shapes. For example, in FIG. 17 the irregular star-shaped controlled overflow drain 118, 518 still contains a controlled high point 200 and a controlled low point 202, despite having multiple points.

Figure 19:
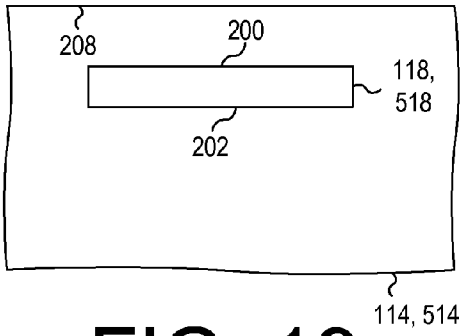
FIG. 19 is a side view of the controlled overflow drain according to a disclosed embodiment.
Figure 20:
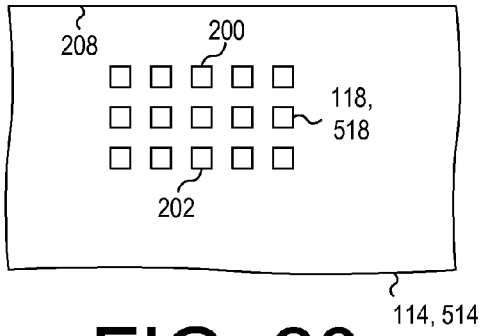
FIG. 20 is a side view of the controlled overflow drain according to a disclosed embodiment.
Figure 21:
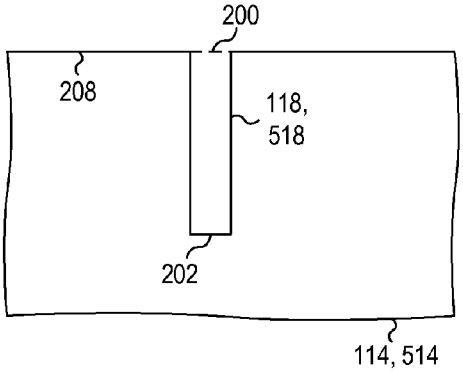
FIG. 21 is a side view of the controlled overflow drain according to a disclosed embodiment.
Figure 22:
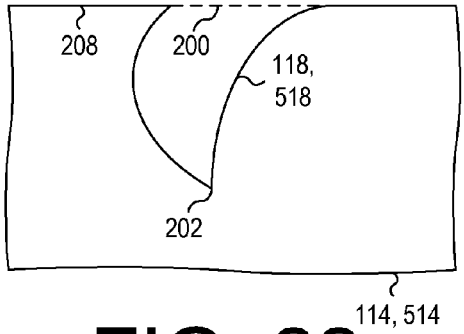
FIG. 22 is a side view of the controlled overflow drain according to a disclosed embodiment.

FIGS. 19-22 demonstrate additional embodiments that the controlled overflow drain 118, 518 can be shaped. FIG. 19 shows a horizontal slot while FIG. 21 shows a vertical slot. FIG. 20 shows a group of small openings that create a controlled overflow drain 118, 518. And FIG. 22 shows a controlled overflow drain 118, 518 that is a circular slice. Notice that all of the shapes, nevertheless, contain a controlled high point 200 and a controlled low point 202.

Figure 24:
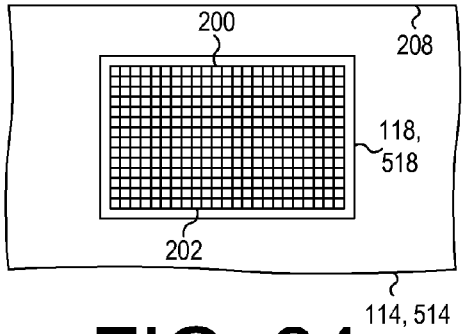
FIG. 24 is a side view of the controlled overflow drain in the form of a screen according to a disclosed embodiment.

The controlled overflow drain 118, 518 can also be a screen as found in, e.g., FIG. 24.

Figure 23:
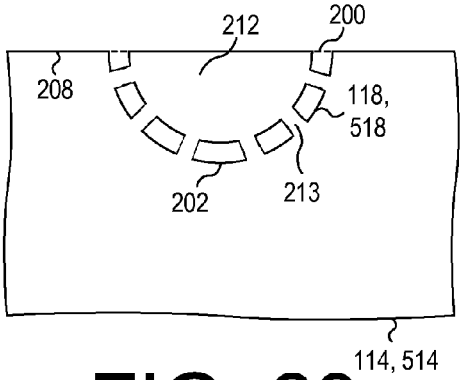
FIG. 23 is a side view of the controlled overflow drain in the form of a blocking piece according to a disclosed embodiment.
Figure 25:
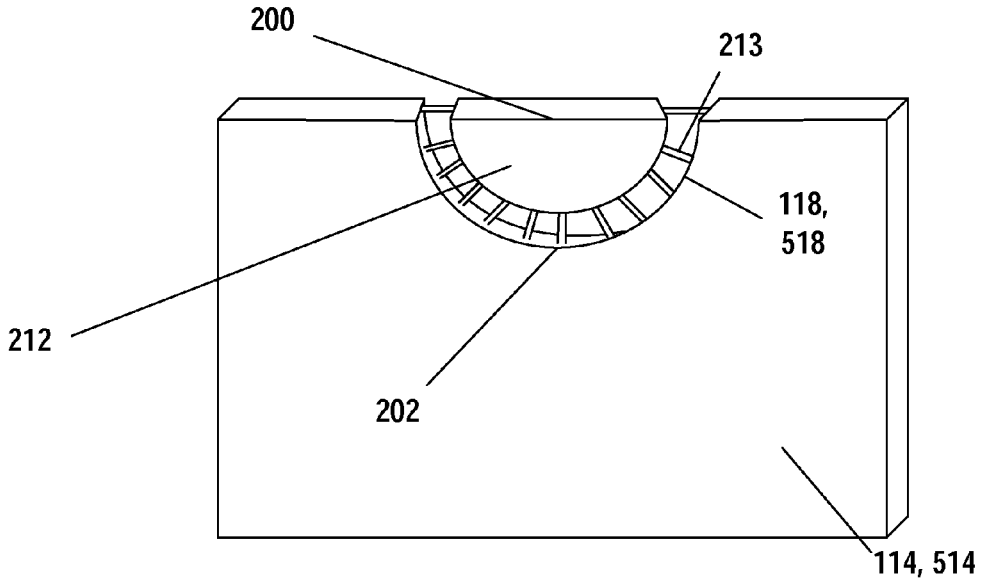
FIG. 25 is an oblique view of the controlled overflow drain in the form of a blocking piece according to a disclosed embodiment.

As shown in FIGS. 23 and 25, the controlled overflow drain 118, 518 can also be formed as a blocking piece 212 that is connected to an exterior wall 114, 514 through a plurality of connection portions 213. When the controlled overflow drain 118, 518 is a blocking piece 212, a user can punch out the blocking piece 212 so that the controlled overflow drain 518 is larger. In other embodiments, the blocking piece 212 must first be punched out to allow the controlled overflow drain 118, 518 to function properly.

Note that the concept of punching out the blocking piece 212 means that the blocking piece 212 can be removed after a certain amount of force is applied to the blocking piece 212, i.e., the plurality of connection portions 213 will break after the certain amount of force is applied. Generally, the amount of force required to remove the blocking piece 212 is less than the amount of force required to break an exterior wall 114, 514, or remove it from the drain pan 106, 506.

There are a variety of embodiments for the plurality of connection portions 213. For example, the plurality of connecting portions 213 can be formed from the exterior wall 114, 514 itself, or additional pieces may be placed into the exterior wall 114, 514.

Figure 26:
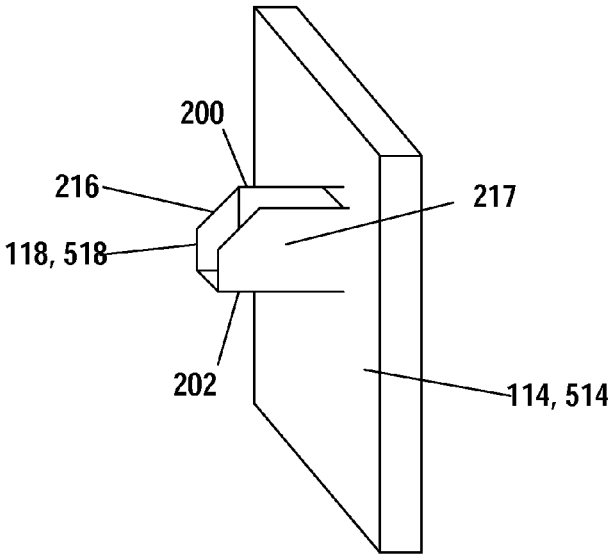
FIG. 26 is an oblique view of the controlled overflow drain in the form of a spout according to a disclosed embodiment.
Figure 27:
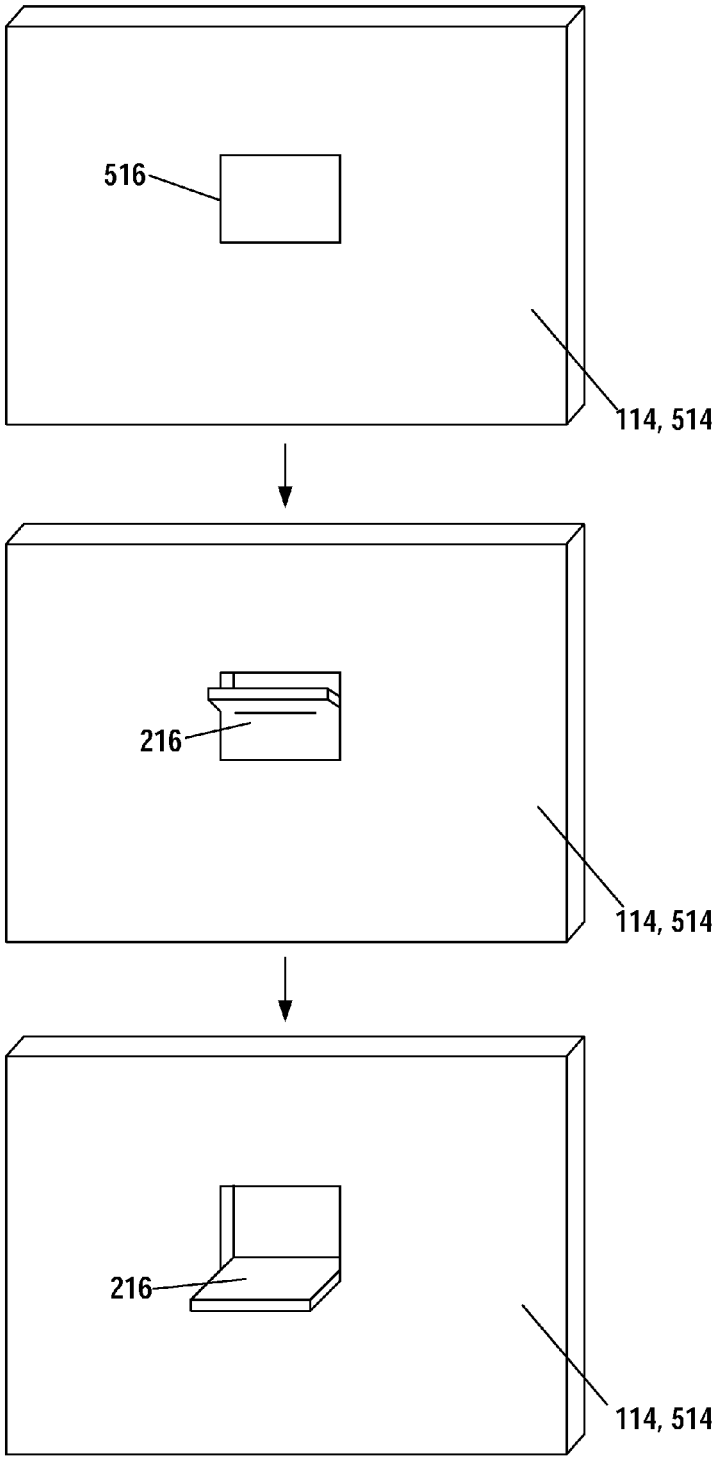
FIG. 27 is a manufacturing process for the controlled overflow drain in the form of a spout using oblique views according to a disclosed embodiment.

As shown in FIGS. 26 and 27, the controlled overflow drain 118, 518 can also be made in the form of a spout 216. The spout 216 allows collected condensation from the drain pan 106, 506 to be emptied. That is, the spout 216 can be positioned so that the water-sensitive element 108 or the air blower 122 will not come into contact with the water flowing out of the spout 216.

In some embodiments, the spout 216 contains side walls 217. However, in other embodiments the spout 216 does not contain side walls 217, as shown in the manufacturing process in FIG. 27.

In one embodiment, a process for manufacturing a spout 216 is as follows: cutting an exterior wall 114, 514 along a cut line 516; bending a spout 216 from the cut line 516 within the exterior wall 114; and forming the spout 216. In other embodiments, first a position within the exterior wall 114 is located. After a position is chosen, a user or a machine cuts into that position, which is now considered the cut line 516. The cut line 516 can be cut in, e.g., three sides to make a spout 216, such as shown in FIG. 27. After the cut line 516 is cut, a user or a machine bends the spout 216 away from the exterior wall 114 to form the spout 216 itself.

In other embodiments, the manufacturer will cut the cut line 516 into the exterior side wall 114. Afterwards, either the consumer or the installer will bend the spout 216 into its correct position, as shown in FIG. 27.

In other embodiments, the spout 216 has an additional step of forming at least one side wall 217 within the side of the spout 216. FIG. 26 shows a spout 216 with two side walls. However, such side walls 216 are absent in other embodiments.

Positioning of the Drains

Figure 28:
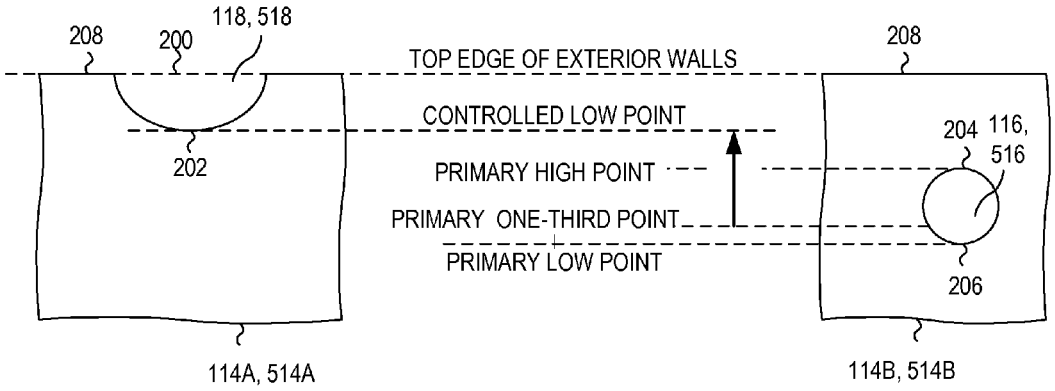
FIG. 28 is a side view comparing the controlled overflow drain with the primary drain according to a disclosed embodiment.

The positioning of the primary drain 116, 516 and the controlled overflow drain 118, 518 is shown in FIG. 28. In this embodiment, the primary drain 116, 516 has a primary low point 206, a primary one-third point, and a primary high point 204. The primary one-third point is at the position about one-third of the way up from the primary low point 206. The controlled overflow drain 118, 518 has a controlled high point 200 and a controlled low point 202. In this embodiment, the controlled high point 200 is located on the top edge 208 of the exterior wall 114, 514.

In the embodiment shown in FIG. 28, the controlled low point 202 is higher than the primary one-third point. The positioning of this embodiment allows condensation to collect within the drain pan 106, 506 up to a point where it will, first, exit through the primary drain 116, 516 until it reaches the one-third point. Thus, when the condensation raises to a level beyond the primary one-third point, it will drain out the controlled overflow drain 118, 518. In other embodiments, the controlled overflow drain 118, 518 is located at a different point with respect to the primary low point 206.

Note that water will rise up the side of the exterior wall 114, 514 when the primary drain 116, 516 fails to completely drain the collected condensation. The primary drain 116, 516 could, e.g., be completely clogged, or partially clogged. When partially clogged, condensation is flowing out the primary drain 116, 516 but the flow rate is not quick enough to prevent the condensation level from reaching the controlled overflow drain 118, 518. The primary drain 116, 516 could be draining collected condensation perfectly fine, but the flow rate of the draining is not occurring fast enough to properly drain the collected condensation.

Figure 29:
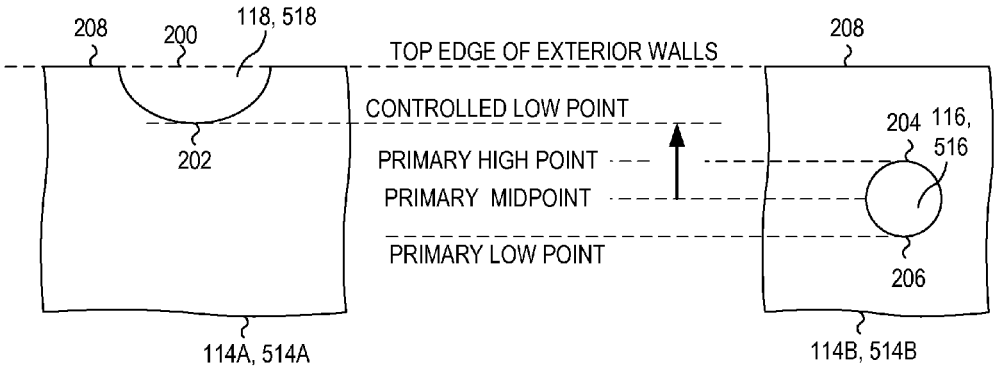
FIG. 29 is a side view comparing the controlled overflow drain with the primary drain according to a disclosed embodiment.

In another embodiment, the relationship between the controlled overflow drain 118, 518 and the primary drain 116, 516 is based on a primary midpoint, rather than a primary one-third point, such as in FIG. 29. In this type of embodiment, the controlled low point 202 is located just above the primary midpoint. The primary midpoint itself is located in the middle of the primary low point 206 and the primary high point 204.

Because of the arrangement in, e.g., FIG. 29, the condensation will, first, collect until it reaches the primary low point 206, and will continue to collect up until it reaches the primary midpoint (if the primary low point 206 is, e.g., clogged). When the condensation reaches above the primary midpoint, however, the condensation will flow out the controlled overflow drain 118, 518.

Note that midpoint and one-third point are just examples and that any suitable point with respect to the primary low point 206 may be used for the controlled low point 202.

As discussed earlier, some embodiments contain a secondary drain 120, 520. The secondary drain 120, 520 contains a secondary low point 220, a secondary midpoint, and a secondary high point 218. The secondary low point 220 is located above the primary low point 206.

Figure 30:
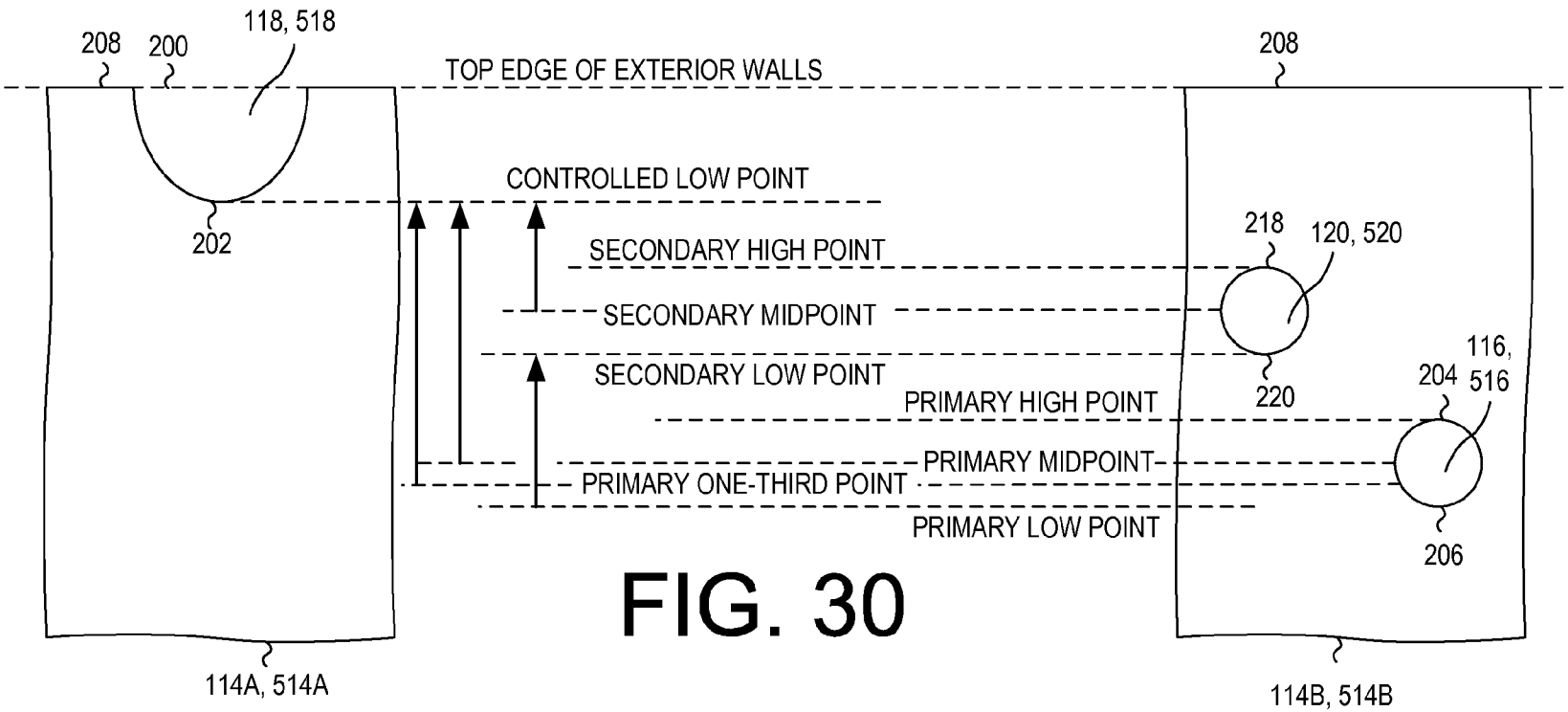
FIG. 30 is a side view comparing the controlled overflow drain with the primary drain and the secondary drain according to a disclosed embodiment.

As shown in FIG. 30, the secondary low point 220 is located above a reference point with respect to the primary low point 206 (e.g., the primary one-third point or the primary midpoint). Similarly, the controlled low point 202 is located above a reference point with respect to the secondary low point 220 (e.g., the secondary one-third point or the secondary midpoint). The secondary one-third point is located one third of the way from the secondary low point 220 to the secondary high point 218, while the secondary midpoint is located in the middle of the secondary low point 220 and the secondary high point 218.

In this type of embodiment, condensation will, first, flow up until it reaches the low point 206 of the primary drain 116, 516. Next, if the primary drain 116, 516 is failing to completely remove the collected condensation, the condensation will continue attempting to flow out of the primary drain 116, 516, and will also start attempting to flow out the secondary drain 120, 520 when it reaches the secondary low point 220. Finally, if the secondary drain 120, 520 is failing, the condensation will continue attempting to flow out the primary drain 116, 516 and the secondary drain 120, 520, and will then flow out of the controlled overflow drain 118, 518 once the condensation reaches the controlled low point 202.

Positioning of the Primary and Secondary Drains

The positioning of the primary drain 116 and the secondary drain 120 is demonstrated in FIG. 30. As previously discussed, the primary drain 116 has a primary high point 204 and a primary low point 206. The secondary drain 120 contains a secondary high point 218 and a secondary low point 220. The secondary low point 220 is located above the primary low point 206 by some amount. This amount could be one-third of the distance between the primary low point 206 and the primary high point 204, one-half of the distance between the primary low point 206 and the primary high point 204, or any desirable reference point sufficiently above the primary low point 206 to indicate that the primary drain 116, 516 is not operating correctly.

As shown in FIG. 30 the controlled overflow drain 118 has a controlled low point 202 and a controlled high point 200. The controlled low point 202 is located above the secondary low point 220 by some amount. This amount could be one-third of the distance between the secondary low point 220 and the secondary high point 218, one-half of the distance between the secondary low point 220 and the secondary high point 218, or any desirable reference point sufficiently above the secondary low point 220 to indicate that the secondary drain 120, 520 is not operating correctly.

Emptying of the Primary Drain

Figure 31:
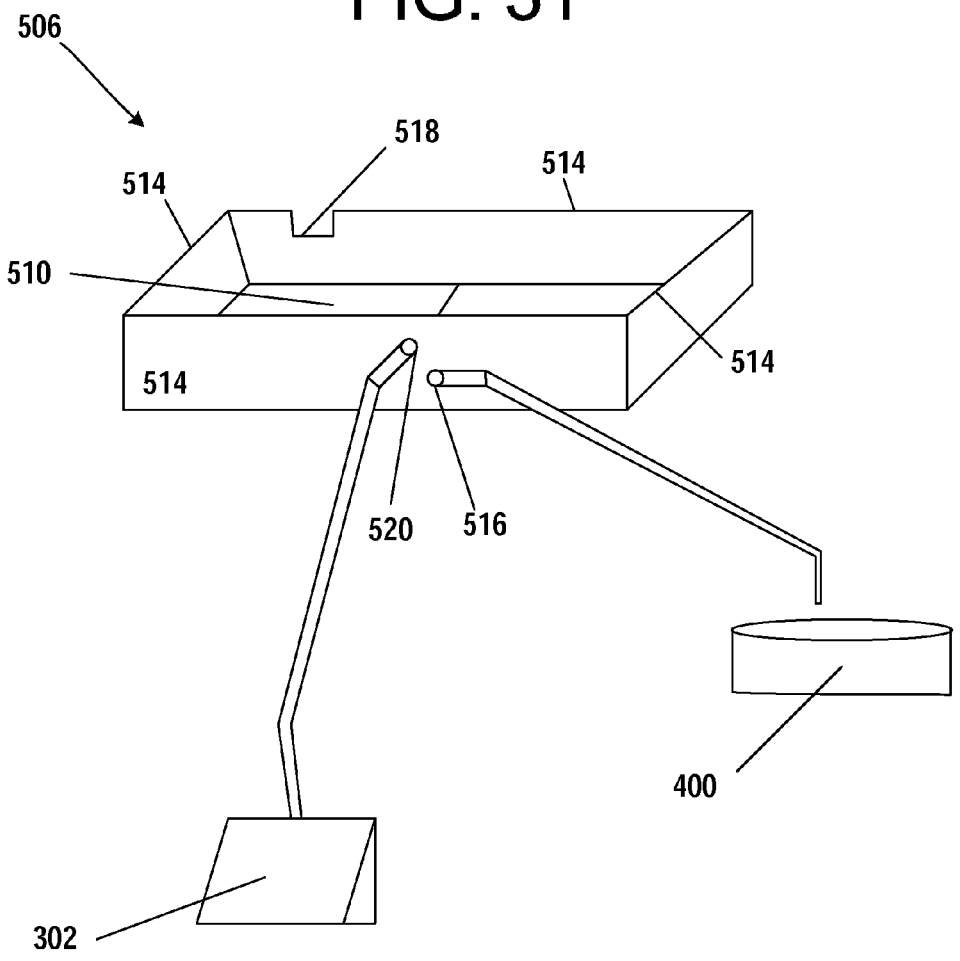
FIG. 31 is an oblique view of the drain pan with the primary drain connected to a collection vessel and the secondary drain connected to an alarm system according to a disclosed embodiment.
Figure 32:
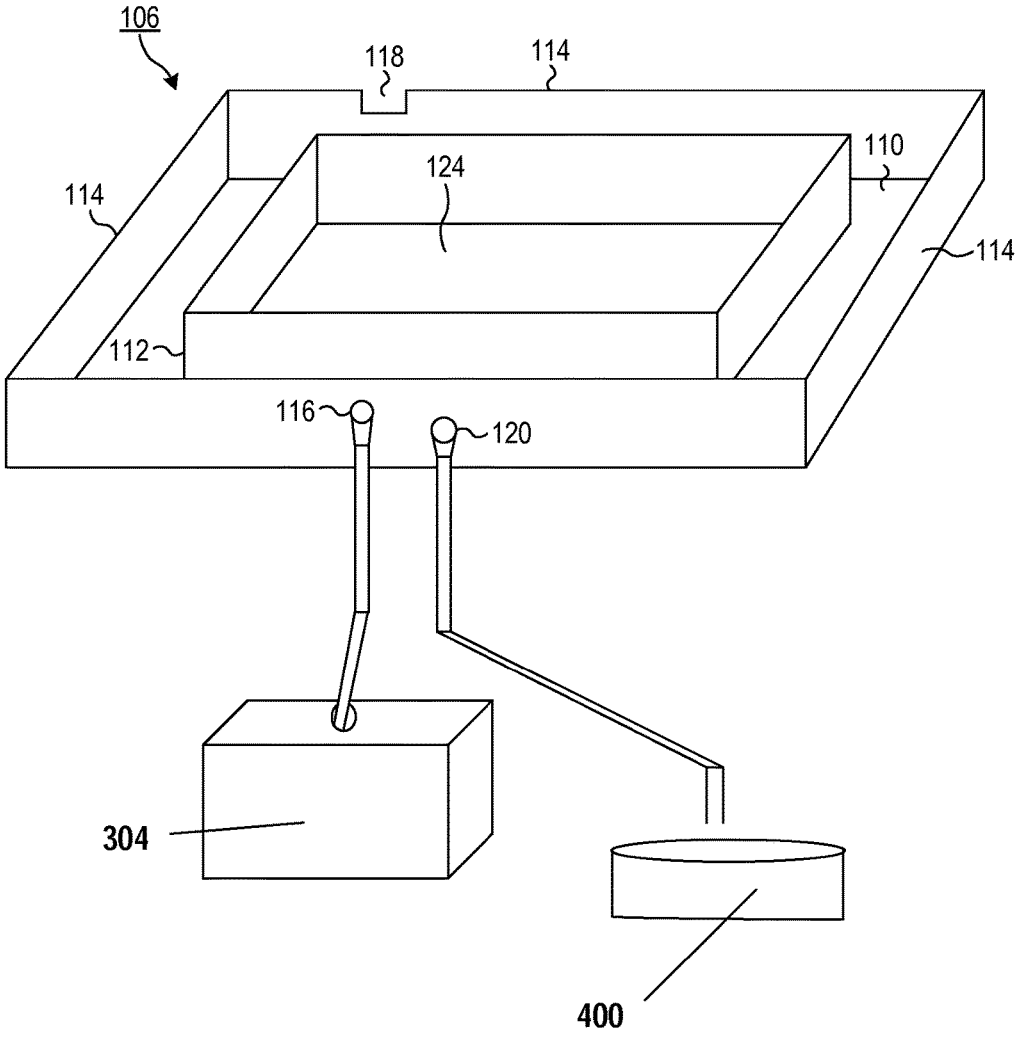
FIG. 32 is an oblique view of the drain pan with the primary drain connected to a collection vessel and the secondary drain connected to a controlled shutoff device according to a disclosed embodiment.
Figure 33:
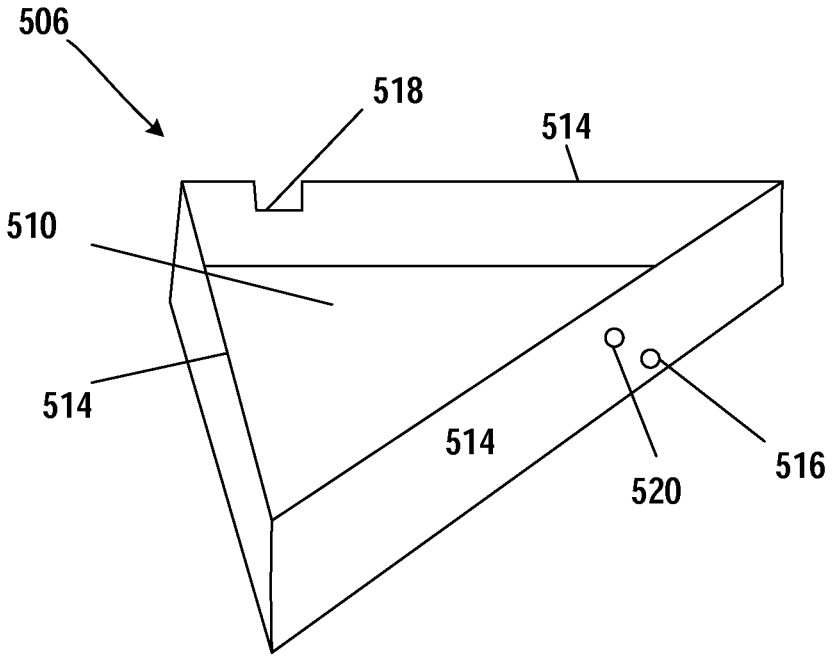
FIG. 33 is an oblique view of the drain pan according to a disclosed embodiment.

Because condensation will typically collect in the interior of the housing 102, condensation will need to be regularly disposed of through the primary drain 116, 516. Generally speaking, the primary drain 116, 516 can drain the collected condensation in a number of ways. For example, the primary drain 116, 516 could drain the collected condensation through attached tubing to a primary drain collection vessel 400, as shown in FIGS. 31 and 32. Alternatively, the primary drain 116, 516 could drain the collected condensation through an attached pipe and to a drain or outside a building in which the air handling unit is being used.

Additionally, in a residential setting, the primary drain 116, 516 could drain the collected condensation to an outdoor garden. Therefore, there are a number of places that the primary drain 116, 516 can drain the collected condensation.

Emptying of the Secondary Drain

In embodiments that contain a secondary drain 120, 520, the secondary drain 120, 520 can lead to an actionable device. For example, in FIG. 31 the secondary drain 120, 520 can lead to an alarm system 302 configured to alert a user that the primary drain 116, 516 is failing. If this occurs, then the user of the air handling unit 100, 400 will become aware that the primary drain 116, 516 is failing to release collected condensation, and can avert the condensation from overflowing the drain pan 106, 506.

In other embodiments, the secondary drain 120, 520 can lead to a controlled shutoff device 304, as shown in FIG. 32. The controlled shutoff device 304 is configured to turn off, at least the heat-exchanging coil 104 so the temperature difference between the interior of the housing 102 and the exterior of the housing 102 will roughly equalize, and condensation will cease to form on the interior.

Note that turning off the heat-exchanging coil 104 will not completely, instantaneously stop condensation from forming. When this occurs, condensation formation will slow down as the temperature is equalizing with the outside environment since the heat-exchanging coil 104 is turned off.

Also, the air handling unit 100, 400 is concerned with condensation collecting within the interior of the unit (and housing 102). This collected condensation could cause the water-sensitive element 108 to malfunction if the collected condensation spills over from the drain pan 106, 506 onto the water-sensitive element 108 or the air blower 122. Thus, this discussion will primarily focus on the condensation collecting within the housing (i.e., the interior).

In addition to this feature, when the controlled shutoff device 304 turns off the heat-exchanging coil 104, a user of the air handling unit may become aware that there is a problem with the primary drain 116, 516.

Multi-sided Drain Pan

The vertical drain pan 106 and the horizontal drain pan 506 are not limited to having four exterior walls 114, 514. For example, in some embodiments the drain pan 106, 506 can be limited to just three sides, such as FIG. 32. In other embodiments, the drain pan 106, 506 can have more than four sides. For example, the drain pan 106, 506 can be an octagonal shape.

The exact shape of the drain pan 106, 506 is formed so that it will collect condensation from the interior of the housing 102. As a result, its shape chosen can vary with each embodiment. For example, when the air handling unit 100, 400 is in the horizontal position, the horizontal drain pan 506 can run the entire width of the air handling unit 100, 400, and the entire length of the heat-exchanging coil 104. Likewise, when the air handling unit 100, 400 is in a vertical position, the outer walls 114 of the vertical drain pan 106 can run along the interior perimeter of the housing 102. Depending on the shape of the housing 102, the drain pan 106, 506 can have three sides, four sides, or five sides, or more, so long as the shape adequately collects condensation from the interior of the air handling unit 100, 400 and the housing 102.

Water-sensitive Element

The identity of the water-sensitive element 108 may vary in different embodiments. The water-sensitive element 108 is a device that is sensitive to water, and can be located within the housing 102 of an air handling unit 100, 400. That is, when water comes into contact with the water-sensitive element 108, it will disrupt its operation. In some embodiments, the water-sensitive element 108 can be an electronic control circuit, a compressor, a thermostat, or a control panel. As noted above, in some embodiments, the water-sensitive element is an electronic control circuit. An electronic control circuit is typically configured to control operation of, among other things, the heat-exchanging coil 104. An electronic control circuit cannot function properly if it becomes wet. When an electronic control circuit gets wet, the water will, e.g., conduct the electricity from a component within the electronic control circuit that can handle a certain voltage to another component that cannot handle the same voltage. Thus, water will cause the electronic control circuit to malfunction.

In other embodiments, the water-sensitive element 108 can be a damper, a sound attenuator, a filter rack, or chambers. Further, in other embodiments, the water-sensitive element 108 can be a cooling element or a heating element.

In addition, the air handling unit 100, 400 is not limited to having just one water-sensitive element 108 below the heat-exchanging coil 104, but can have multiple water-sensitive elements 108.

It should be noted as well that, although it is identified separately from the water-sensitive element 108, the air blower 122 is also sensitive to water, and should be protected from any overflow of condensation from the appropriate drain pan 106, 506. Since the air blower 122 contains an electric motor, it may malfunction if it gets wet.

CONCLUSION

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

What is claimed is:

1. A condensation collection system, comprising:

a housing that includes an interior;

a heat-exchanging coil located within the interior of the housing;

a drain pan located within the interior of the housing and underneath the heat-exchanging coil, the drain pan being configured to collect condensation from the interior of the housing, the drain pan including a bottom, at least three or more exterior walls that are connected together to generally conform to an interior perimeter of the housing, the at least three or more exterior walls have a top peripheral edge and a bottom peripheral edge opposite to the top peripheral edge, the bottom peripheral edge is attached to the bottom of the drain pan, a primary drain located on a first exterior wall selected from the at least three or more exterior walls and below the top peripheral edge of the drain pan, the primary drain being configured to drain collected condensation from the drain pan; and a controlled overflow drain located on a second exterior wall selected from the at least three or more exterior walls, the controlled overflow drain is configured to drain the collected condensation from the drain pan, the controlled overflow drain is exposed to the interior of the housing and all edges of the controlled overflow drain are uncovered, a highest point of the controlled overflow drain intersects the top peripheral edge of the drain pan; and a water-sensitive element located in the housing and underneath both the heat-exchanging coil and the bottom of the drain pan, the water-sensitive element is located perpendicular to the top peripheral edge and the bottom of the drain pan, wherein the controlled overflow drain directs the collected condensation to avoid contacting the water-sensitive element during an overflow past the primary drain.

2. The condensation collection system of claim 1, wherein the drain pan further comprises at least three or more interior walls that define an aperture in the drain pan.

3. The condensation collection system of claim 1, wherein the second exterior wall is different from the first exterior wall.

4. The condensation collection system of claim 1, wherein the lowest point of the controlled overflow drain is higher than a primary midpoint halfway between the lowest point of the primary drain and the highest point of the primary drain.

5. The condensation collection system of claim 1, wherein the controlled overflow drain includes a spout configured to drain the collected condensation.

6. The condensation collection system of claim 1, wherein the controlled overflow drain includes a blocking piece connected to the second exterior wall by a plurality of connecting portions, the connecting portions being structurally weaker than the second exterior wall.

7. The condensation collection system of claim 1, wherein the water-sensitive element is an electronic control circuit configured to control operation of the heat-exchanging coil.

8. The condensation collection system of claim 1, wherein the controlled overflow drain is formed in the first exterior wall and a third exterior wall selected from the at least three or more exterior walls, the third exterior wall being adjacent to the first exterior wall, the controlled overflow drain being formed across a corner of the drain pan where the first and third exterior walls intersect.

9. The condensation collection system of claim 1, wherein the water-sensitive element is a device that is susceptible to being damaged by a water overflow.

10. The condensation collection system of claim 1, wherein the controlled overflow drain is positioned such that the collected condensation will avoid contacting the water-sensitive element.

11. The condensation collection system of claim 1, wherein the water-sensitive element is not located under the controlled overflow drain.

12. The condensation collection system of claim 1, wherein the controlled overflow drain is located at a position of the second exterior wall that does not face the water-sensitive element.

13. The condensation collection system of claim 1, wherein the water-sensitive element is located in the housing and underneath both the heat-exchanging coil and the drain pan at a position that avoids contact with water.

14. The condensation collection system of claim 1, wherein the controlled overflow drain directs the collected condensation away from the water-sensitive element during the overflow past the primary drain.

15. A condensation collection system, comprising:

a housing;

a heat-exchanging coil located in the housing;

a drain pan located in the housing and underneath the heat-exchanging coil, the drain pan being configured to collect condensation from an interior of the housing, the drain pan including a bottom, at least three or more exterior walls that generally conform to an interior perimeter of the housing, a primary drain located on a first exterior wall selected from the at least three or more exterior walls, the primary drain being configured to drain collected condensation from the drain pan, and a controlled overflow drain located on a second exterior wall selected from the at least three or more exterior walls, the controlled overflow drain being configured to drain the collected condensation from the drain pan; and a water-sensitive element located in the housing and underneath both the heat-exchanging coil and the drain pan, wherein a shortest distance on a horizontal plane between the water-sensitive element and the controlled overflow drain is greater than one-half a length of the shortest exterior wall, and a lowest point of the controlled overflow drain is higher than a primary one-third point located one-third of the way from a lowest point of the primary drain to a highest point of the primary drain.

16. A condensation collection system, comprising:

a housing;

a heat-exchanging coil located in the housing;

a drain pan located in the housing and underneath the heat-exchanging coil, the drain pan being configured to collect condensation from an interior of the housing, the drain pan including a bottom, at least three or more exterior walls that generally conform to an interior perimeter of the housing, a primary drain located on a first exterior wall selected from the at least three or more exterior walls, the primary drain being configured to drain collected condensation from the drain pan, and a controlled overflow drain located on a second exterior wall selected from the at least three or more exterior walls, the controlled overflow drain being configured to drain the collected condensation from the drain pan; and a water-sensitive element located in the housing and underneath both the heat-exchanging coil and the drain pan, wherein the drain pan further includes at least one secondary drain located on the first exterior wall, the secondary drain being configured to drain the collected condensation from the drain pan, wherein a lowest point of the controlled overflow drain is higher than a secondary midpoint halfway between a lowest point of the secondary drain and a highest point of the secondary drain, and a lowest point of the secondary drain is higher than the one-third point of the primary drain.

17. The condensation collection system of claim 16, wherein the secondary drain leads to an alarm system configured to alert a user to a failure in the primary drain.

18. The condensation collection system of claim 16, wherein the secondary drain leads to a controlled shutoff device, which is configured to shut off the heat-exchanging coil.

* * * * *